US009982431B2

(12) United States Patent
Del missier

(10) Patent No.: US 9,982,431 B2
(45) Date of Patent: May 29, 2018

(54) MODULAR FRAME STRUCTURE

(71) Applicant: TECNO S.P.A., Milan (IT)

(72) Inventor: Daniele Del missier, Milan (IT)

(73) Assignee: TECNO S.P.A., Milan (IT)

( * ) Notice: Subject to any disclaimer, the term of this patent is extended or adjusted under 35 U.S.C. 154(b) by 24 days.

(21) Appl. No.: 15/039,094

(22) PCT Filed: Oct. 30, 2014

(86) PCT No.: PCT/IB2014/065707
§ 371 (c)(1),
(2) Date: May 25, 2016

(87) PCT Pub. No.: WO2015/075586
PCT Pub. Date: May 28, 2015

(65) Prior Publication Data

US 2016/0356039 A1 Dec. 8, 2016

(30) Foreign Application Priority Data

Nov. 25, 2013 (IT) ..... MI2013A1961

(51) Int. Cl.
*E04B 2/74* (2006.01)
*E04B 2/82* (2006.01)
*E06B 3/66* (2006.01)

(52) U.S. Cl.
CPC ..... *E04B 2/7448* (2013.01); *E04B 2/7401* (2013.01); *E04B 2/82* (2013.01);
(Continued)

(58) Field of Classification Search
CPC ..... E04B 2/7448; E04B 2/7401; E04B 2/82; E04B 2002/7462; E04B 2002/7464; E04B 2002/7492; E04B 2002/825
See application file for complete search history.

(56) References Cited

U.S. PATENT DOCUMENTS 3,081,849 A * 3/1963 Eugene ..... E04B 2/96 49/413
3,292,328 A * 12/1966 Darling ..... E04B 2/82 52/238.1

(Continued)

FOREIGN PATENT DOCUMENTS

EP 2246495 A1 11/2010
FR 2070476 A5 * 9/1971 ..... E04B 2/7854

(Continued)

OTHER PUBLICATIONS

International Search Report for PCT/IB2014/065707 dated Jan. 27, 2015.

*Primary Examiner* — Christine T Cajilig
(74) *Attorney, Agent, or Firm* — Thomas Horstemeyer, LLP

(57) ABSTRACT

A modular frame structure (1) of a partition wall made of glass panes, or other pane material, or pane (7), comprises: —a side assembly (2) to form at least one of the lower side, or base, of the frame structure (1), or the upper side, or cross bar, of the frame structure (1), or a mount, or column member arranged between the base and the cross bar, of the frame structure (1); —said side assembly (2) comprising—a track (3) suitable to firmly connect to the ceiling or the floor or a support structure, said track (3) having body extending along a preset first longitudinal extent (X-X); —said assembly further comprising a telescopic section bar (4), suitable to be connected to said track (3); —said telescopic section bar (4) forming at least one invitation and coupling seat (5) and being suitable to receive a coupling section bar (6) secured to said pane (7); —said invitation and coupling seat (5) being defined by a sliding and resting wall (8) that, with an edge (9) thereof, defines a seat opening (10) through which the seat (5) opens to the outside of said telescopic section bar (4); —said invitation and coupling seat (5) being (Continued)

defined by a bottom wall (11) comprising a snap-coupling device seat (12) in which a snap-coupling device (18) is received with a base portion (17) thereof so that a body portion (19) thereof projects cantilever in said invitation and coupling seat (5) and, facing said sliding and resting wall (8), forms therewith a coupling slit (20) that, in disengaging conditions, has reduced dimensions going towards said seat opening (10); —said body portion (19) of said snap-coupling device (18) having a shape and a material allowing an elastic deformation thereof to snap-receive said coupling section bar (6) in said coupling slit (20) so that an undercut (16) provided for in said coupling section bar (6) is coupled by the mutual action of the snap-coupling device (18) and the sliding and resting wall (8).

15 Claims, 19 Drawing Sheets

(52) U.S. Cl.
CPC ..... *E04B 2/825* (2013.01); *E06B 3/6621* (2013.01); *E04B 2002/7462* (2013.01); *E04B 2002/7464* (2013.01); *E04B 2002/7492* (2013.01)

(56) References Cited

U.S. PATENT DOCUMENTS

| | | | | |
|---|---|---|---|---|
| 5,083,405 | A | 1/1992 | Miller | |
| 5,524,402 | A * | 6/1996 | Sykes | E04L 32/7424 52/126.3 |
| 6,260,321 | B1 | 7/2001 | Rudduck | |
| 8,544,223 | B1 | 10/2013 | Konstantin | |
| 9,506,246 | B2 * | 11/2016 | Joseph | E06L 33/5821 |
| 2006/0179788 | A1 * | 8/2006 | Nicoletti | E04L 32/7453 52/741.15 |
| 2008/0134610 | A1 | 6/2008 | Jakob-Bamberg et al. | |
| 2009/0241443 | A1 | 10/2009 | Flynn | |
| 2010/0199596 | A1 | 8/2010 | Gosling | |
| 2015/0376899 | A1 * | 12/2015 | Joseph | E04B 2/7401 52/241 |

FOREIGN PATENT DOCUMENTS

| | | | | |
|---|---|---|---|---|
| GB | 2520925 | A * | 6/2015 | E04B 2/7401 |
| WO | WO-2011054721 | A1 * | 5/2011 | E04B 2/745 |
| WO | 2013028155 | | 2/2013 | |

* cited by examiner

FIG. 2
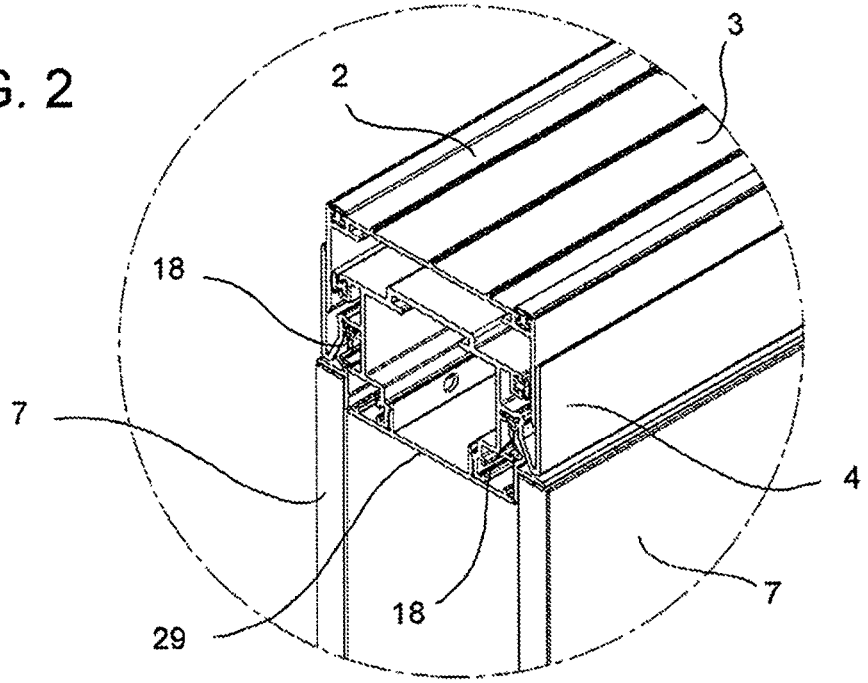
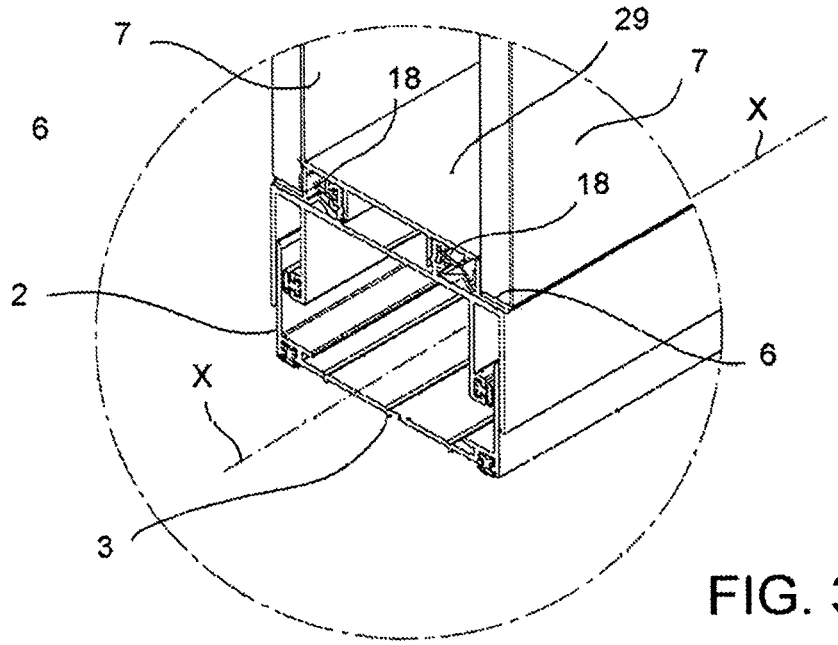
FIG. 3

MODULAR FRAME STRUCTURE

CROSS-REFERENCE TO RELATED APPLICATION

This application is the 35 U.S.C. § 371 national stage application of PCT Application No. PCT/IB2014/065707, filed Oct. 30, 2014, where the PCT claims priority to and the benefit of, IT Patent Application No. MI2013A001961, filed Nov. 25, 2013, both of which are herein incorporated by reference in their entirety.

FIELD OF THE INVENTION

The present invention relates to a modular frame structure, a modular partition wall, as well as to a method for mounting the modular structure and the modular partition wall.

In particular, the present invention relates to a modular frame structure of a wall made of glass panes; pane or plate; or other pane material, or pane.

BACKGROUND ART

The modular frames for movable wall are used mainly to divide a room into multiple environments, where carrying out an invasive intervention for the modification of the layout of the place, for example, by erecting a partition wall, is not desired.

The frames of the prior art are usually composed of a plurality of upper cross bars secured to the ceiling, vertically on top of a plurality of bases secured to the floor, connected to a plurality of mounts, or uprights, that compose the sides of the frame.

The mount is secured to the cross bar and the base by angular connecting members.

Each of these sides of the frame (cross bars, bases, and mounts) is usually composed of joiners or joiner section bars of couplable by means of screws, or snap-couplable, formed by two portions, generally section bars, connected by screw or snap-fit securing means, which, in the assembled configuration, form a pane compartment that is so configured as to receive an edge portion of the pane and to lock it on both sides of the pane.

The pane compartment of the base further receives a support member, suitable to support the pane weight in the operative position thereof.

The mounting of the wall first occurs by securing a cross bar to the ceiling, vertically on top of a base secured to the floor. A mount is then connected to the cross bar and the base. The pane is rested onto the support member of the base in the vertical operative position thereof. Subsequently, the snap joiners are assembled so that the edge portions of the pane are received in the pane compartments. The method hereto described is repeated so as to place a new pane side by side to the preceding one, thus forming the wall.

Examples are given by the documents, WO 2013/028155, U.S. Pat. No. 8,544,223, U.S. Pat. No. 5,083,405, U.S. Pat. No. 6,260,321, U.S. 2008/134610, U.S. 2009/241443, U.S. 2010/0199596, EP 2 246 495.

The frame structure of the type described above, while being satisfactory from multiple viewpoints, has a number of drawbacks.

First, the frame structure described above does not provide for the possibility of compensating possible errors in the relative vertical positioning between the cross bar and the base during the installation. This forces to the use of skilled labor, and it further involves an increase in the installation times.

The joiners that snap-close, thus forming the seat for the pane, do not ensure a constant and repeatable pressure transversally to the pane, hence a connection safety that is able to support even accidental impacts.

Furthermore, the snap joiners that are used do not have a high mechanical strength, unless the thickness of the frame sides is oversized, in which case the aesthetics of the wall is compromised, which is to the detriment of the overall safety, especially in the case that heavy panes are used, as the soundproof multilayer panels.

Finally, the described frame structure has a considerable designing complexity of the environment in which it will be arranged, and of the installation thereof, which makes it unsuitable to solutions where the movable wall has to be uninstalled and subsequently frequently reinstalled, such as, for example, in offices.

Solution

Therefore, the need is particularly felt, to obtain a modular frame structure, as well as a partition wall, which simplifies the connection of the panes, while preserving a high operative safety, increasing the mounting precision.

A further need that is felt is to drastically reduce the designing times of the environments and, especially, the mounting times, without for this to the detriment of the mounting precision and aesthetical characteristics, in particular hiding, the connecting or coupling members to the sight.

Therefore, the object of the present invention is to propose a modular frame structure that allows achieving the above-mentioned needs, as well as solving the drawbacks of the prior art hereto mentioned.

These and other objects are achieved by a structure according to claims 1 and 5, a wall according to claim 6, and a method of use or maintenance according to the claims 9 and 10.

Some advantageous embodiments are the object of the dependent claims.

By virtue of the provision of the characteristics of the structure according to the invention, it is possible to obtain a product which is simple to be manufactured and mounted, at the same time being able to preserve a high mounting and operative safety.

Furthermore, by virtue of the characteristics of the structure according to the invention, it is possible to ensure a higher mounting rapidity, without compromising the installation precision, while improving the aesthetics of the structure.

FIGURES

Further characteristics and advantages of the structure according to the invention will be apparent in the description set forth below of preferred embodiment examples thereof, given by way of illustrative, non-limiting example, with reference to the annexed figures, in which:

FIG. 2 represents in axonometric view the particular A of FIG. 1;

FIG. 3 illustrates in axonometric view the particular B of FIG. 1;

DESCRIPTION OF SOME PREFERRED EMBODIMENT EXAMPLES

Figure 1:
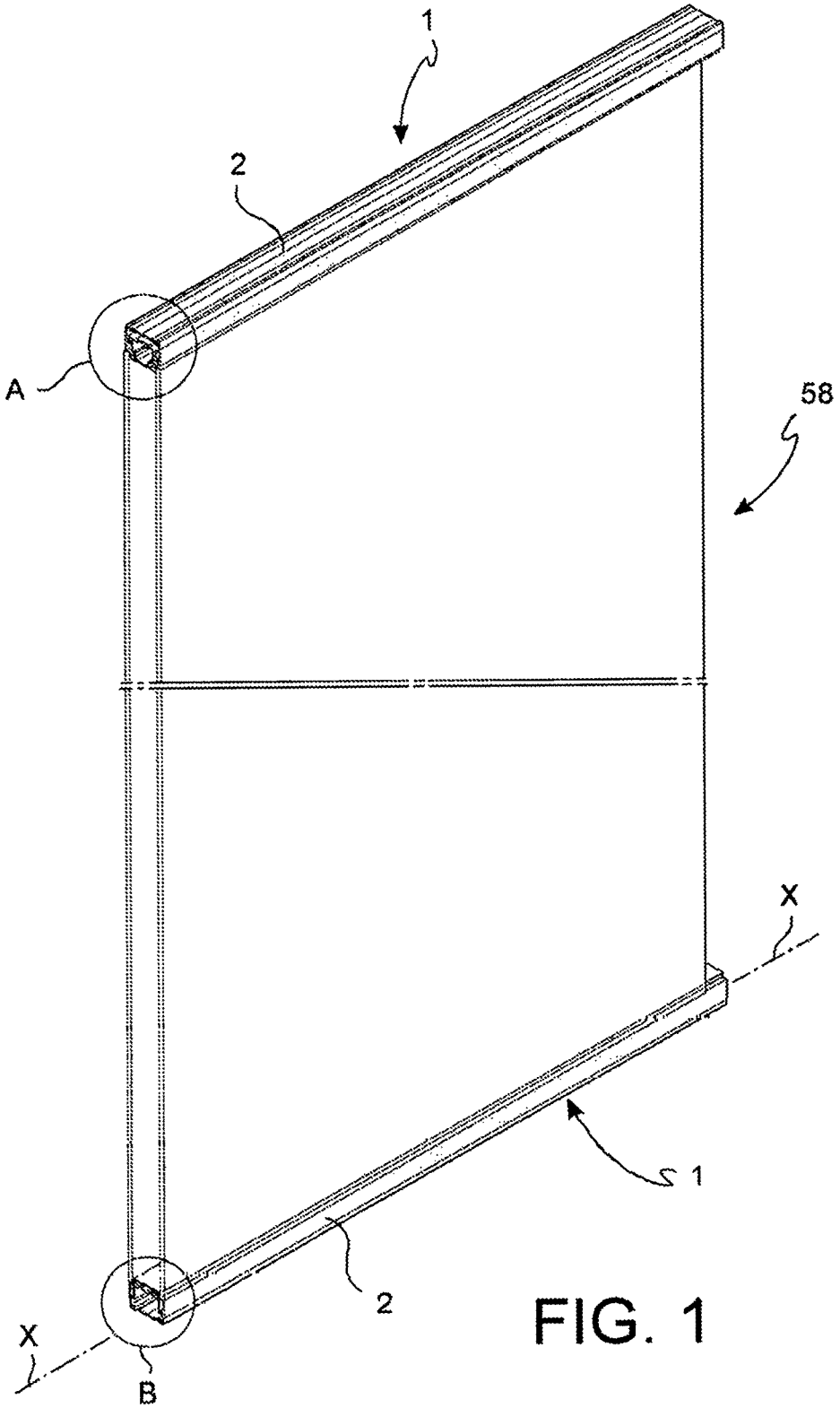
FIG. 1 represents, in axonometric view, a partition wall, in this case with a double pane or facing panes, having the frame structures of the invention.
Figure 4:
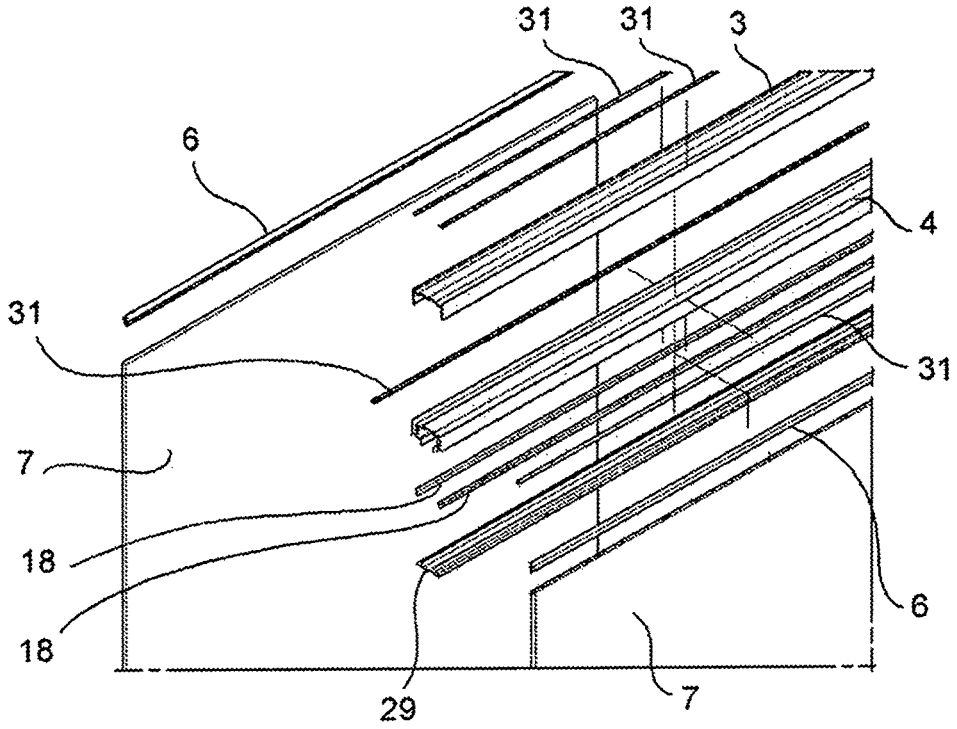
FIG. 4 represents, in axonometric view with separated parts, the particular of FIG. 2.
Figure 5:
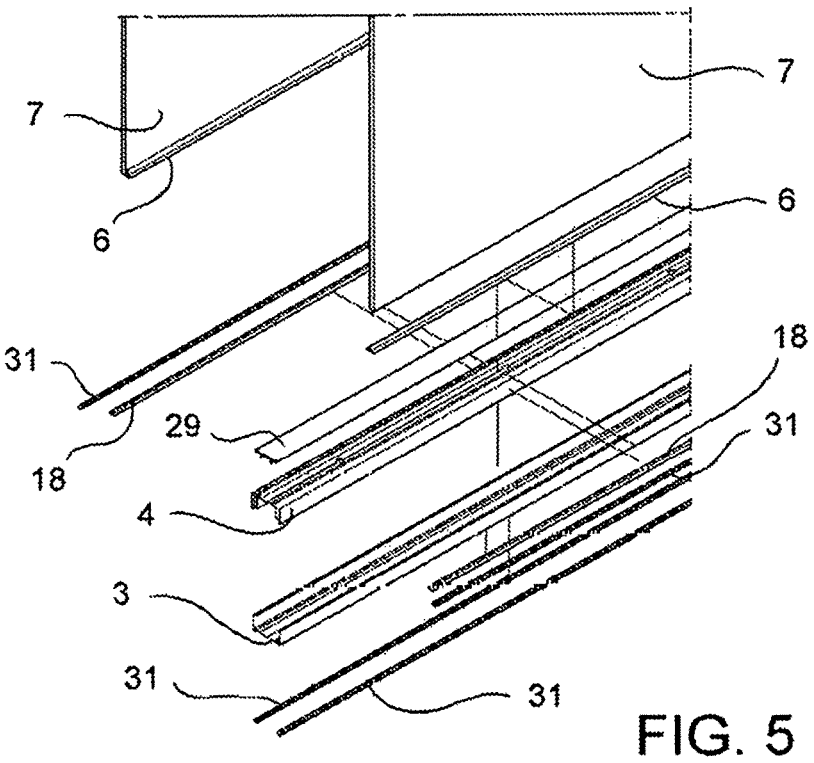
FIG. 5 represents in axonometric view with separated parts, the particular of FIG. 3.
Figure 6:
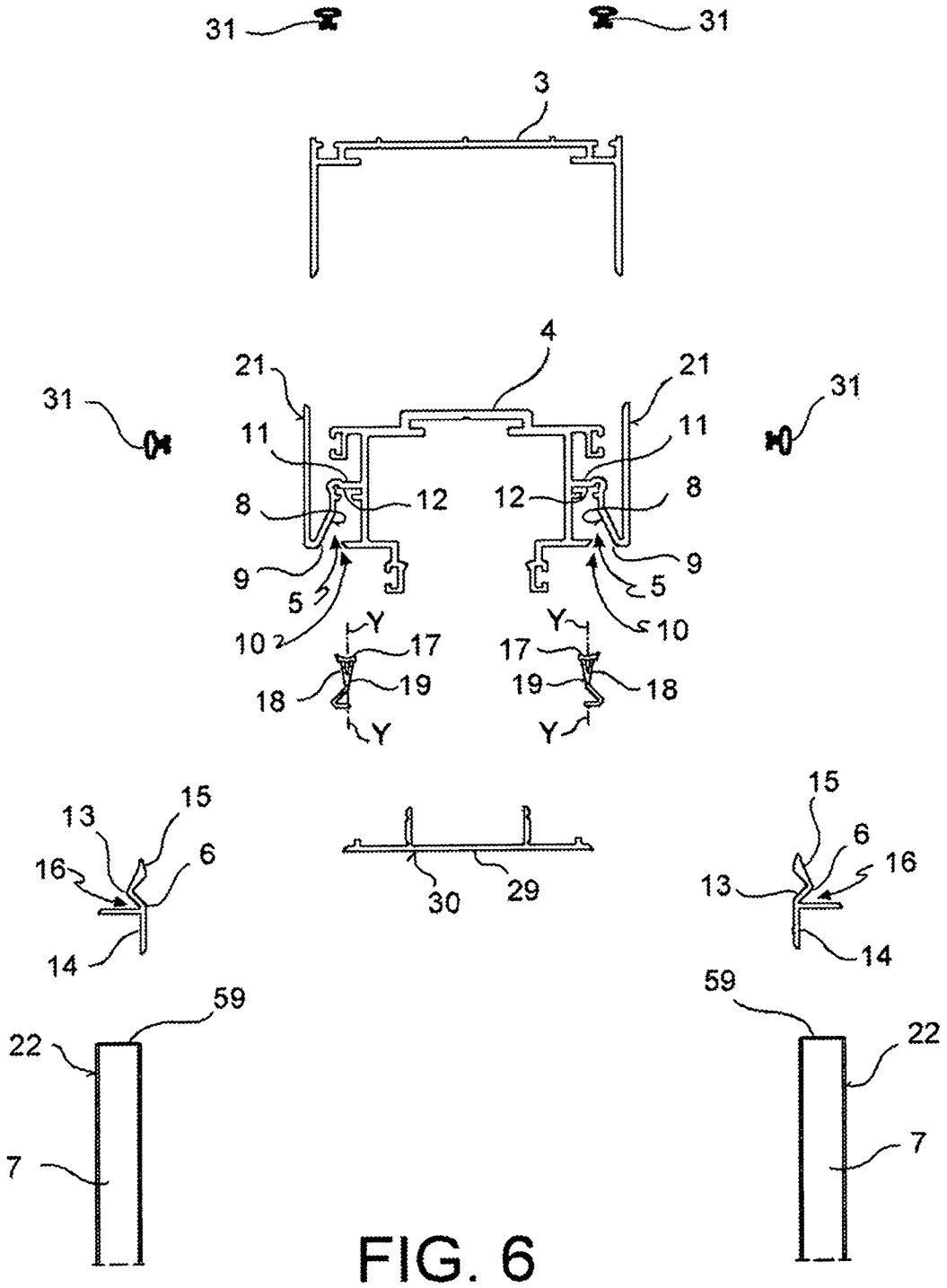
FIG. 6 represents in sectional view with separated parts, the particular of FIG. 2.
Figure 7:
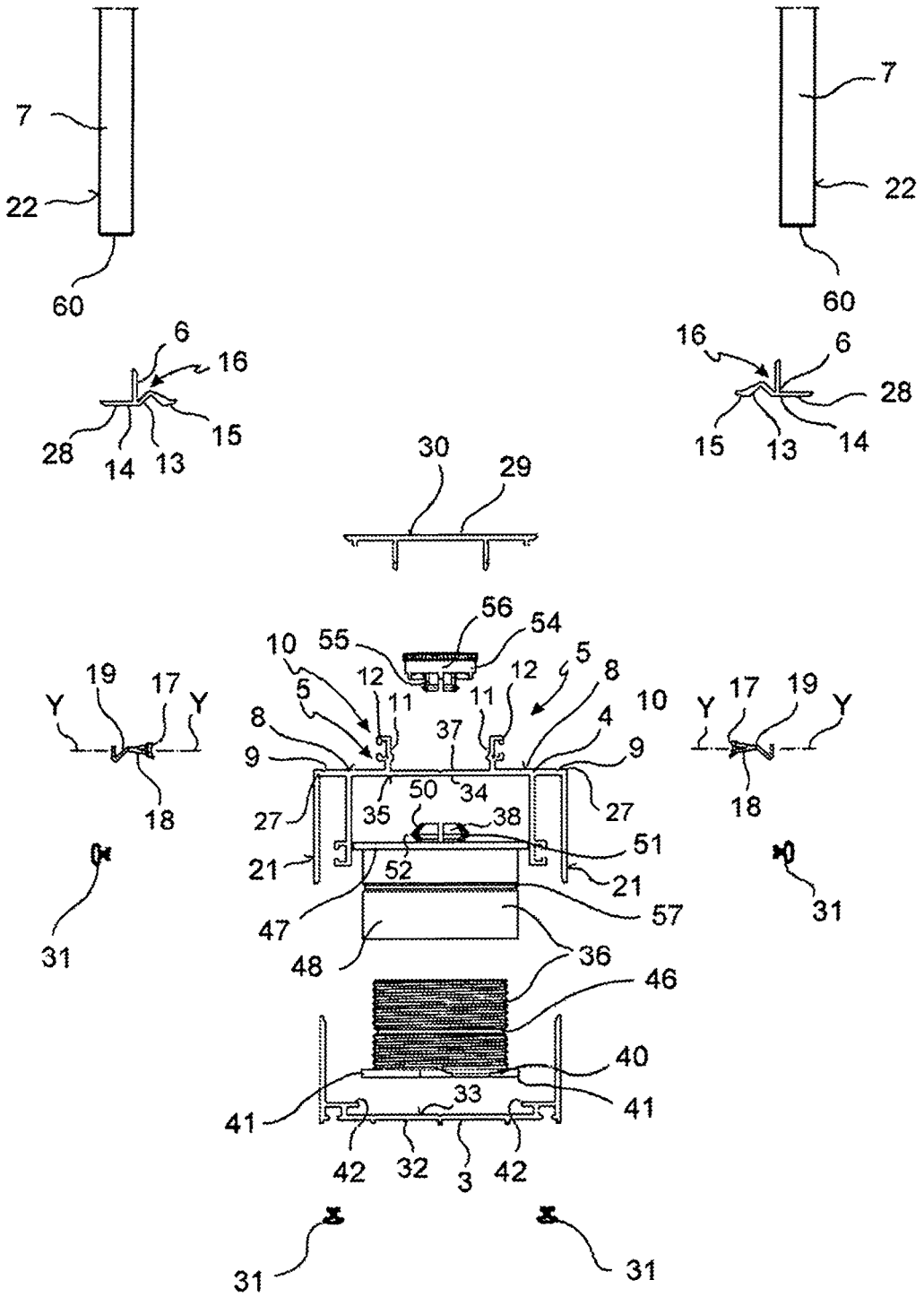
FIG. 7 represents in sectional view with separated parts, the particular of FIG. 3.
Figure 8:
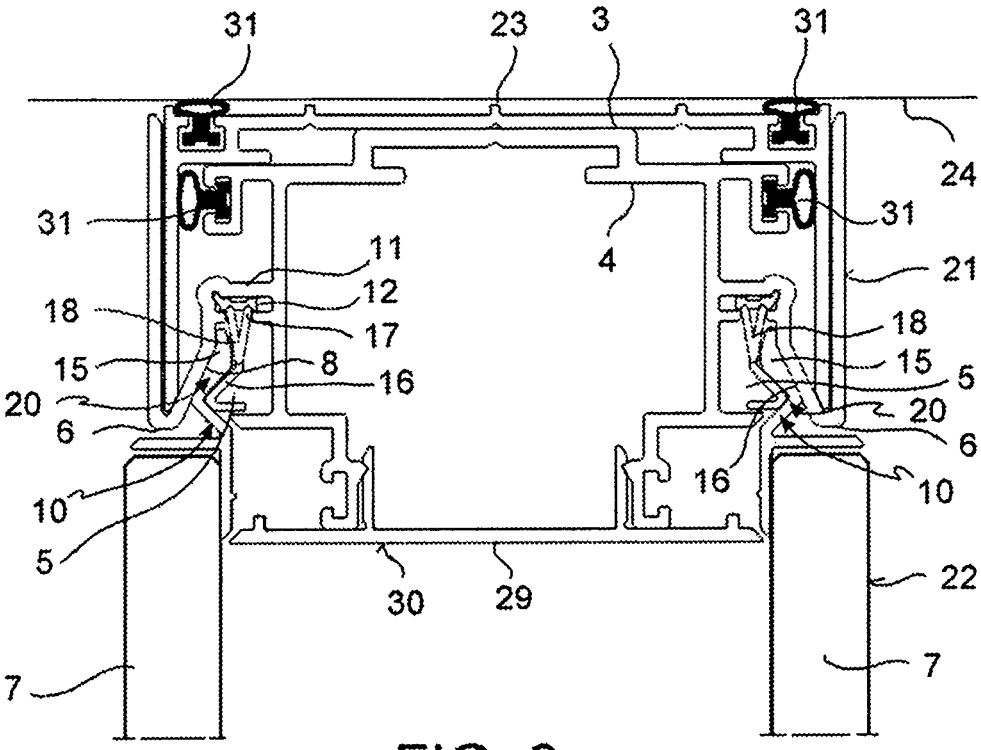
FIG. 8 represents in sectional view the particular of FIG. 2.
Figure 9:
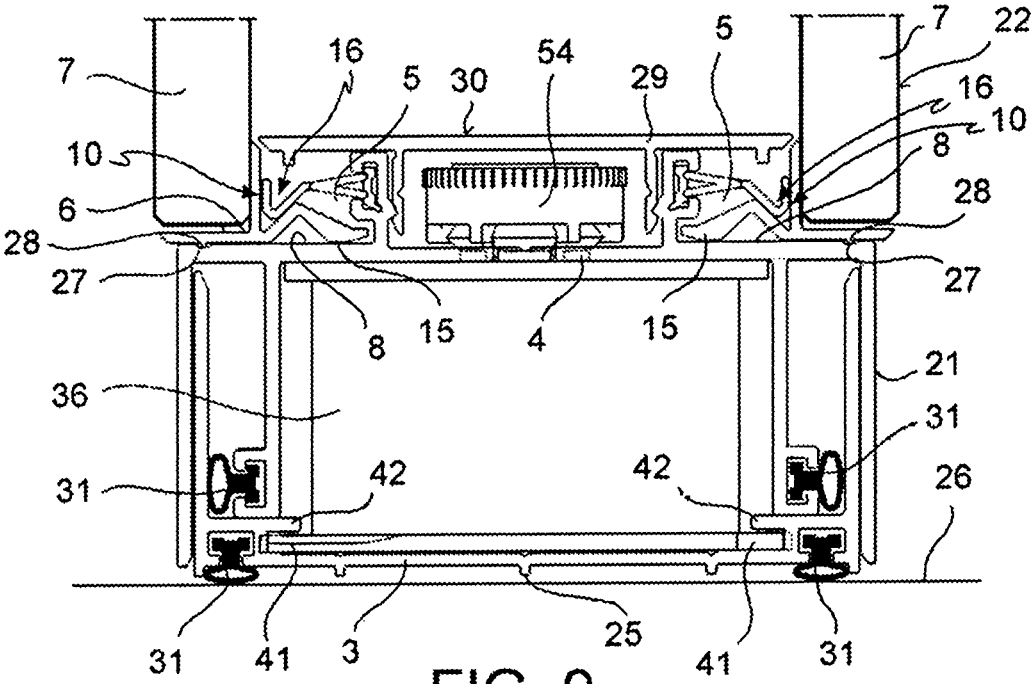
FIG. 9 represents in sectional view the particular of FIG. 3.
Figure 10:
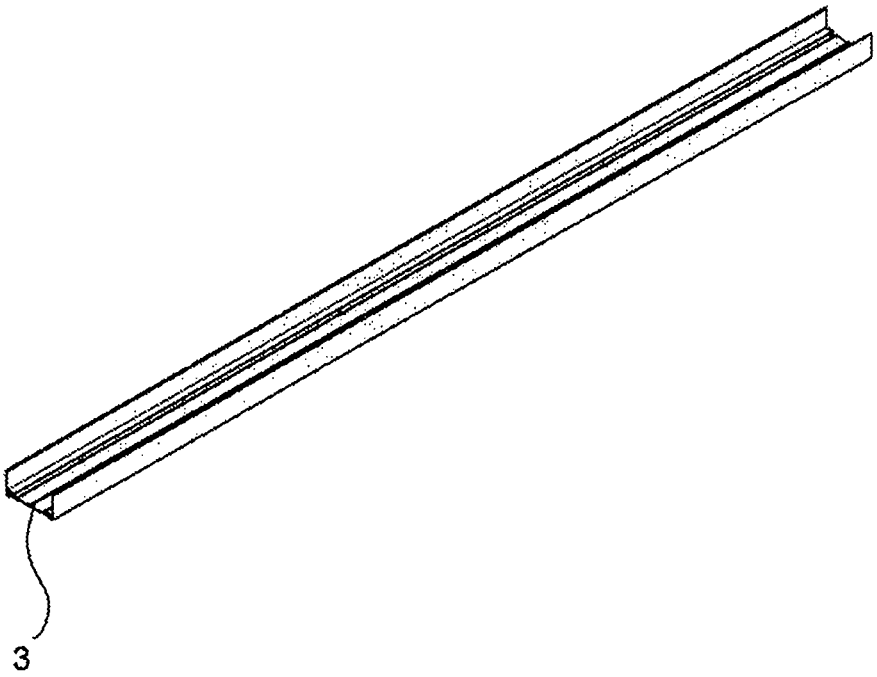
FIG. 10 represents in axonometric view a first step of the mounting of the structure and the partition wall.
Figure 11:
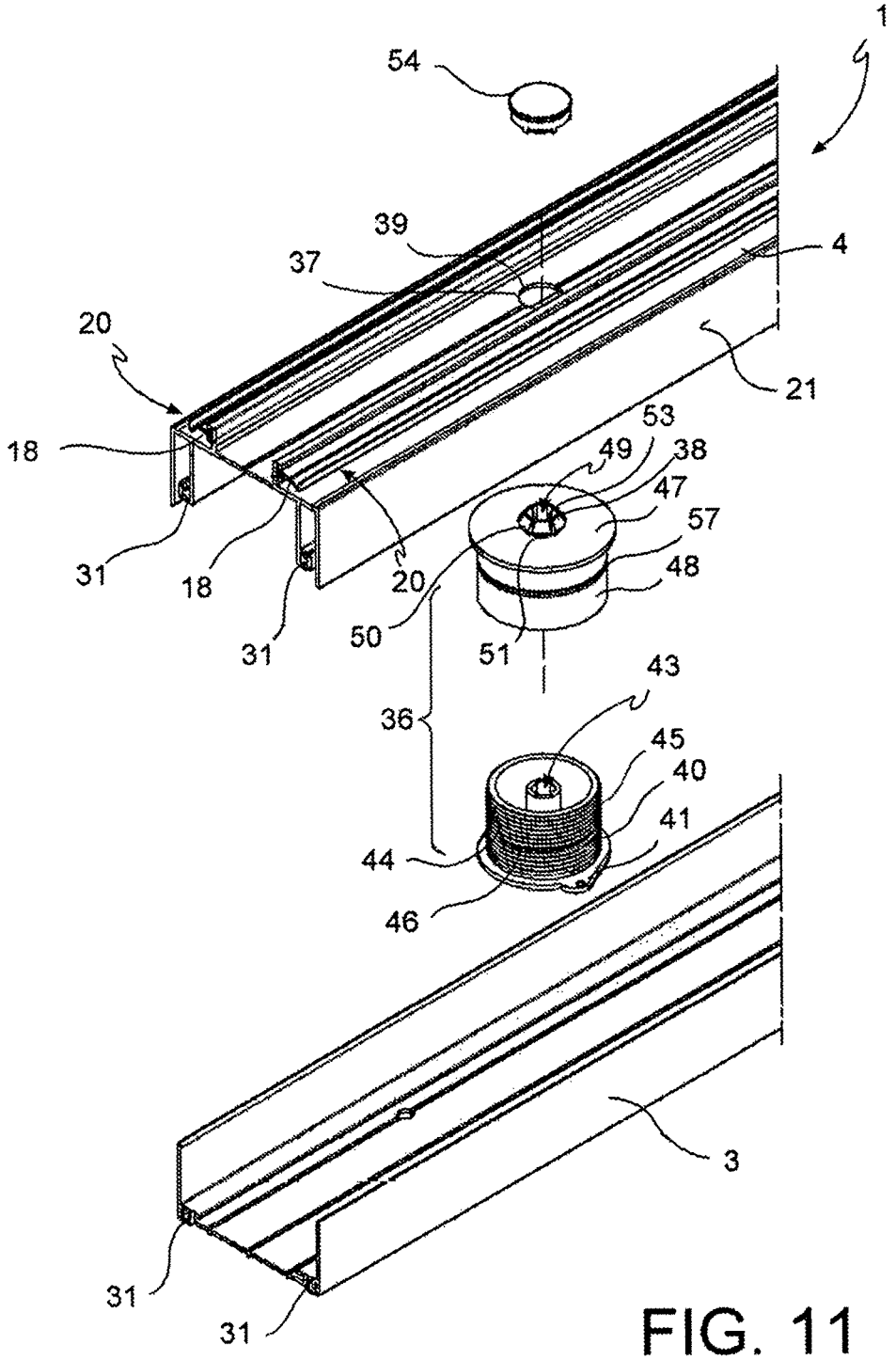
FIG. 11 represents in axonometric view and with separated parts a second step of the mounting of the structure and the partition wall.
Figure 12:
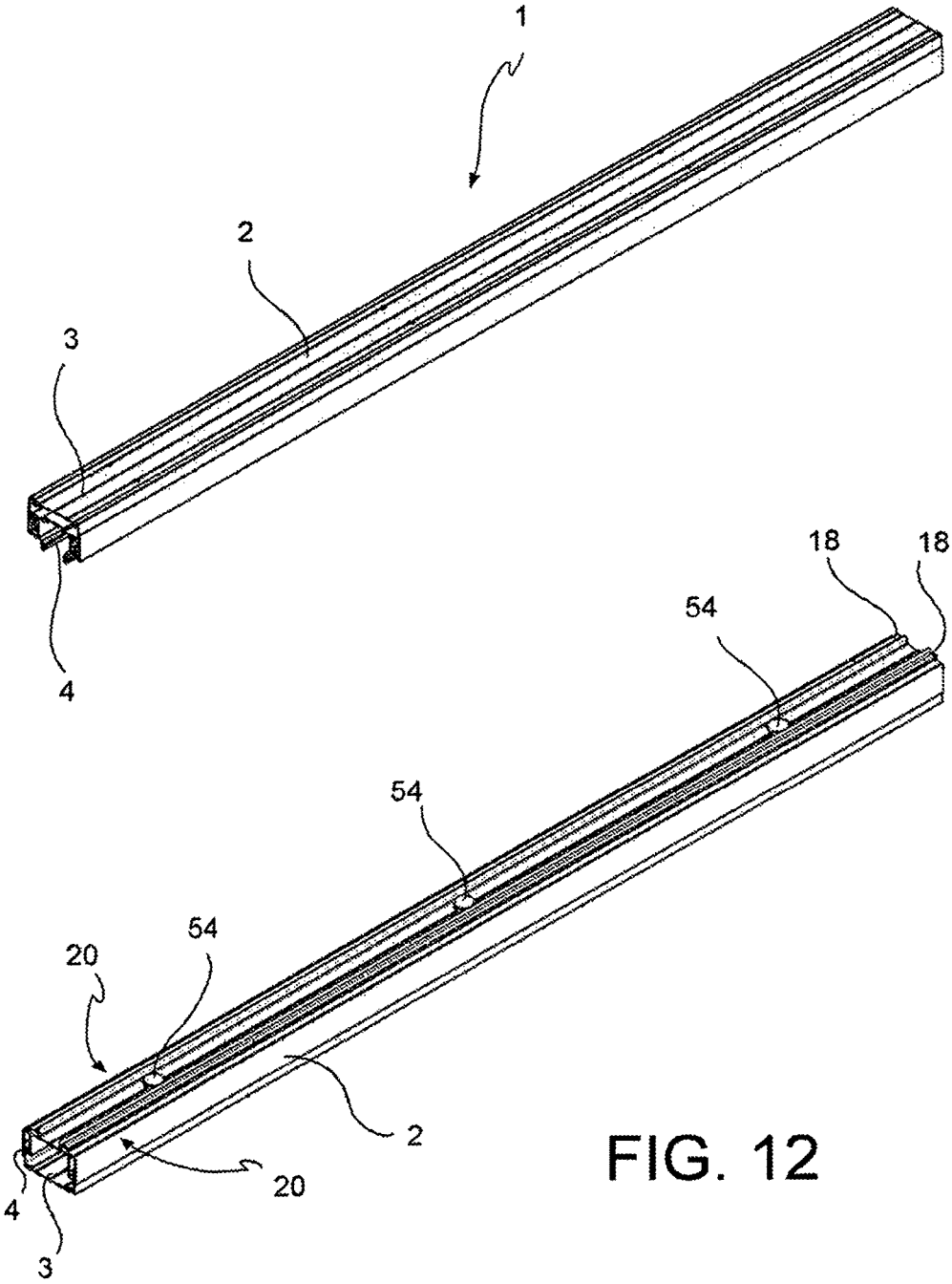
FIG. 12 represents in axonometric view a third step of the mounting of the structure and the partition wall.
Figure 13:
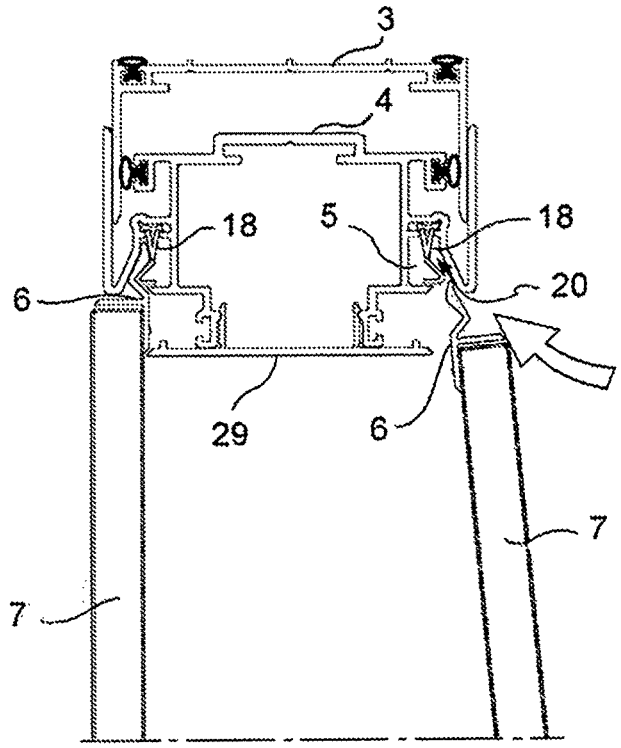
FIG. 13 represents in sectional view a fourth step of the mounting of the structure and the partition wall, and in particular of the step of insertion and snap connection of the upper edge of a pane to the upper side assembly or cross bar.
Figure 14:
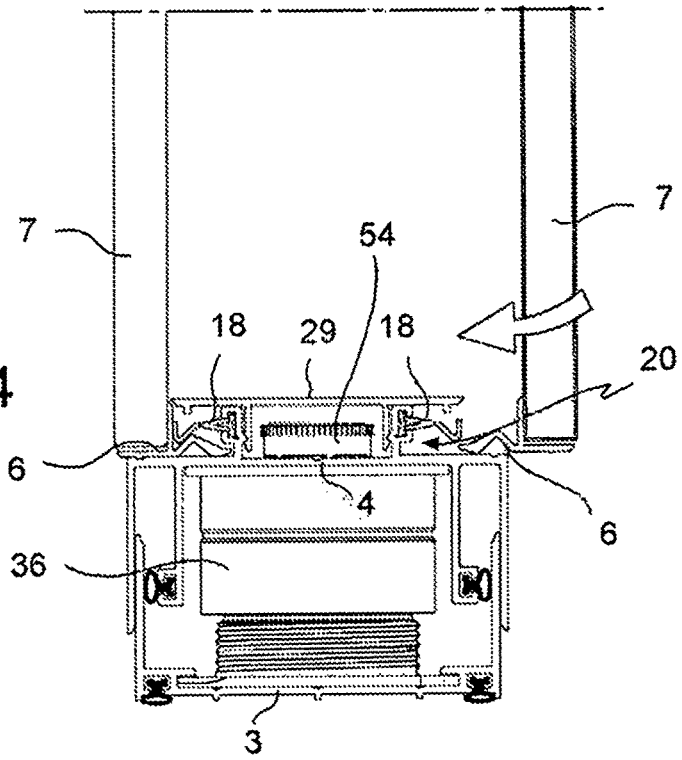
FIG. 14 represents in sectional view a fifth step of the mounting of the structure and the partition wall and in particular of the step of insertion and snap connection of the lower edge of a pane to the lower side assembly or base.
Figure 15:
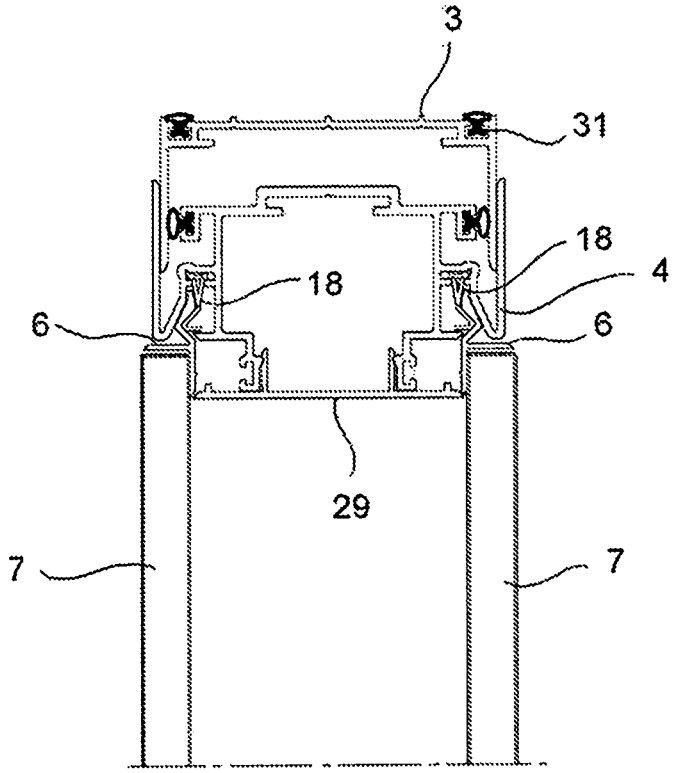
FIGS. 15 and 16 illustrate in sectional view the upper and lower particulars, respectively, of a mounted partition wall with a double pane or facing panes.
Figure 16:
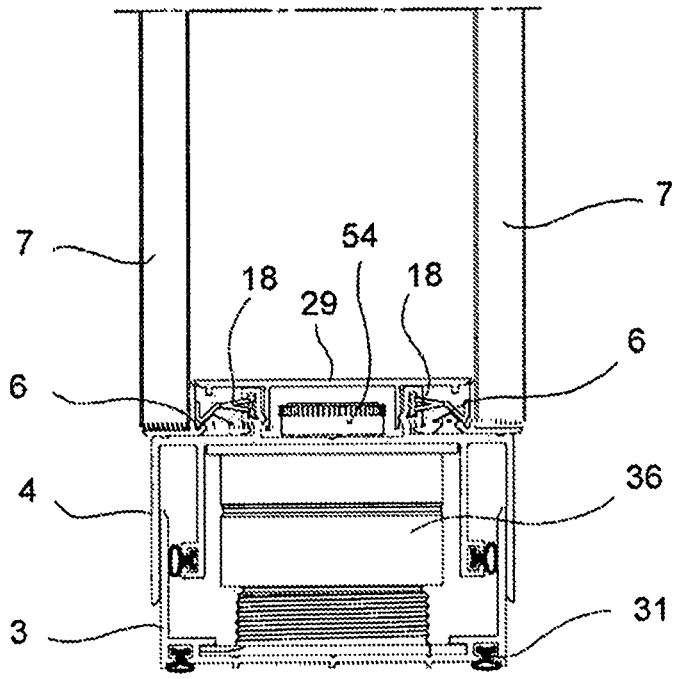
Figure 17:
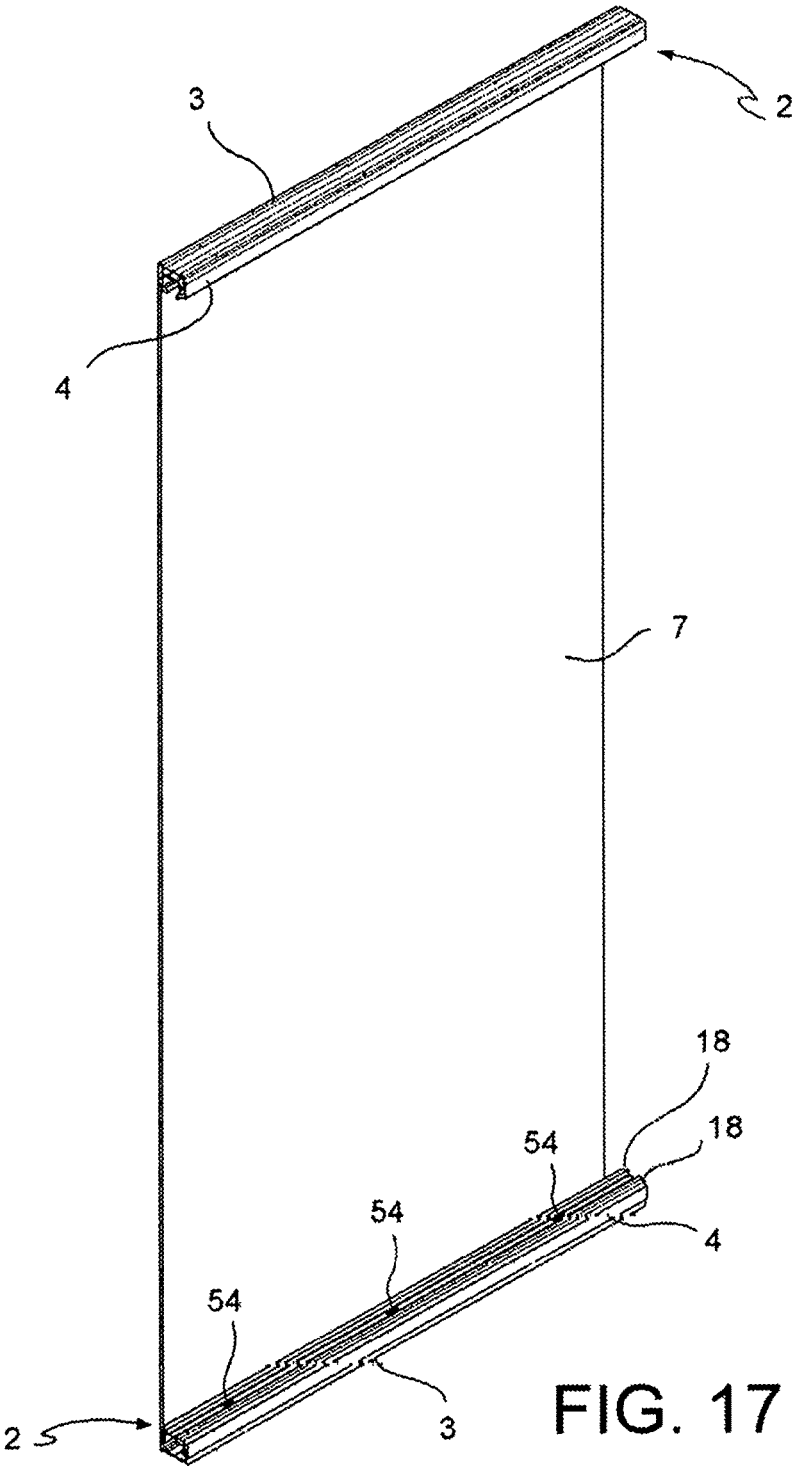
FIGS. 17 and 18 show in axonometric view two steps of the mounting of a partition wall with a single pane.
Figure 18:
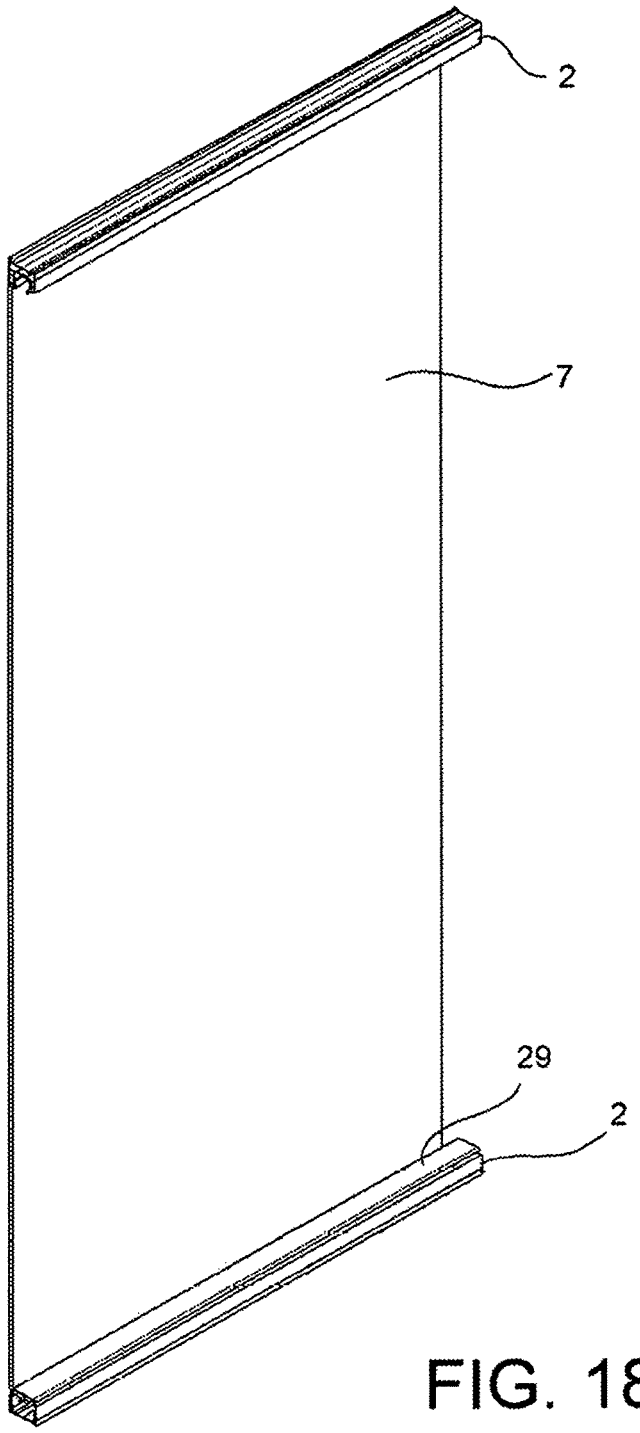
Figure 19:
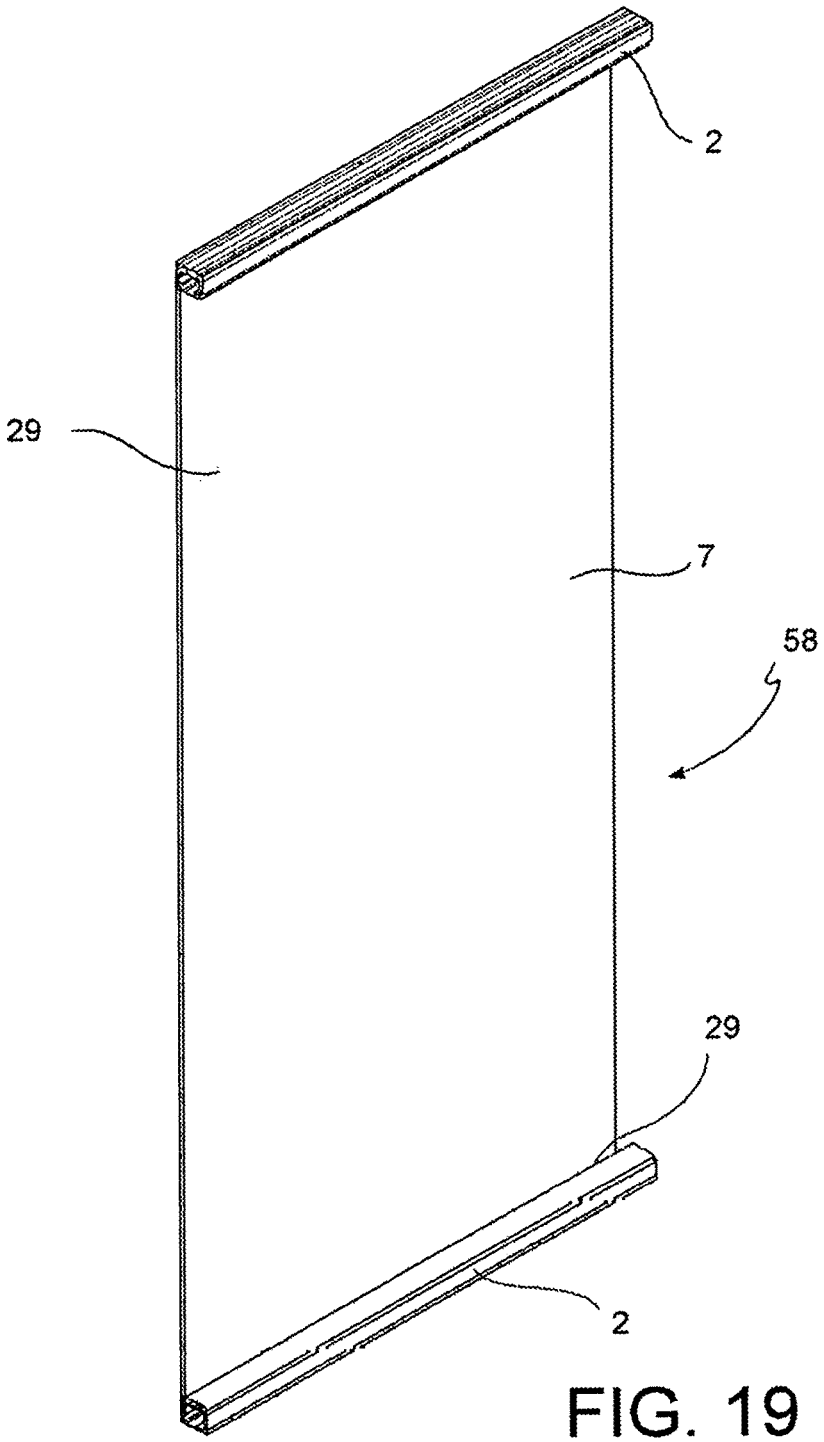
FIGS. 19 and 20 show in axonometric view two further steps of mounting of a partition wall with a double pane or facing panes.
Figure 20:
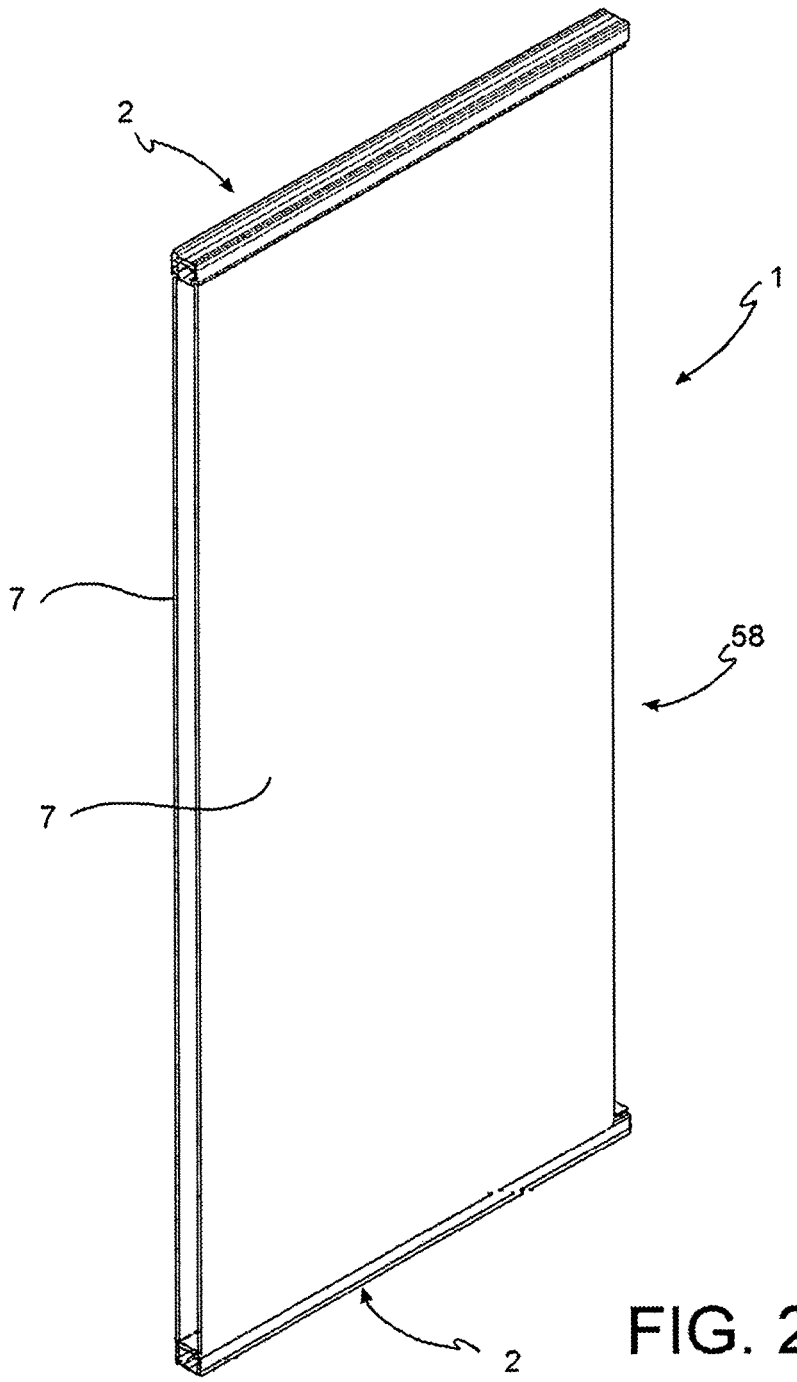
Figure 21:
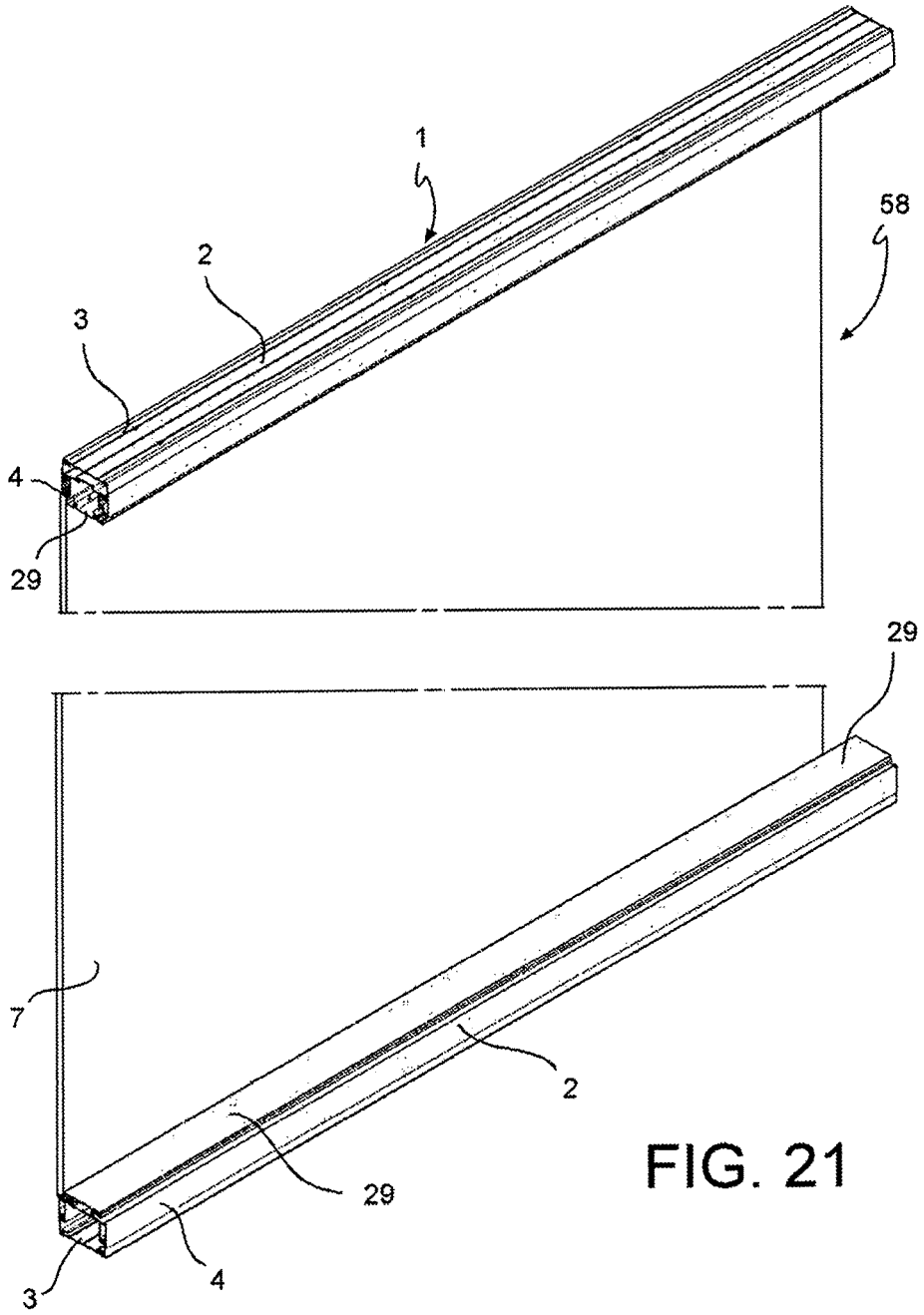
FIG. 21 shows an axonometric view of a partition wall, in the case with a single pane, having the frame structure, according to an embodiment.
Figure 22:
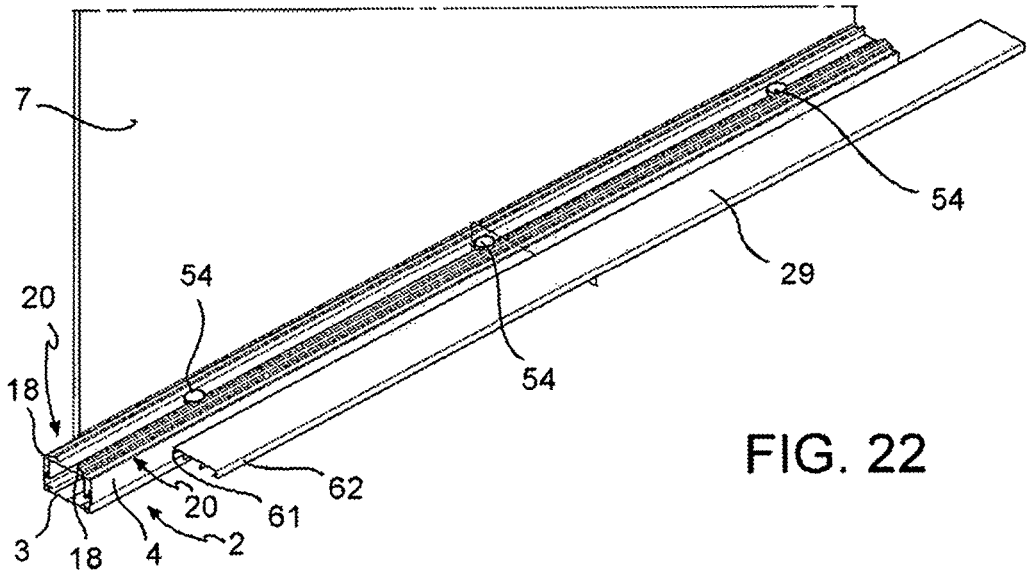
FIG. 22 shows in axonometric view a partition wall according to the invention in which at least one pane is provided for, which is arranged only on one side of the side assembly, and also, but with separated parts, the covering and finishing section bar has locking means of the accidental uncoupling of the pane and side covering means of the invitation and coupling seat.
Figure 23:
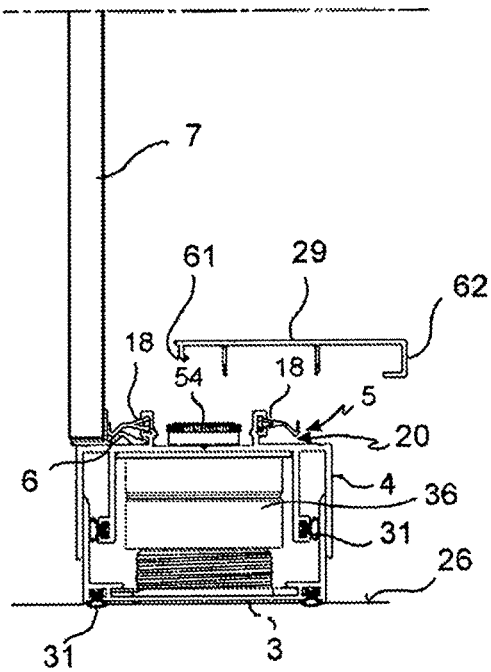
FIG. 23 shows in cross-sectional view the partition wall of FIG. 22.
Figure 24:
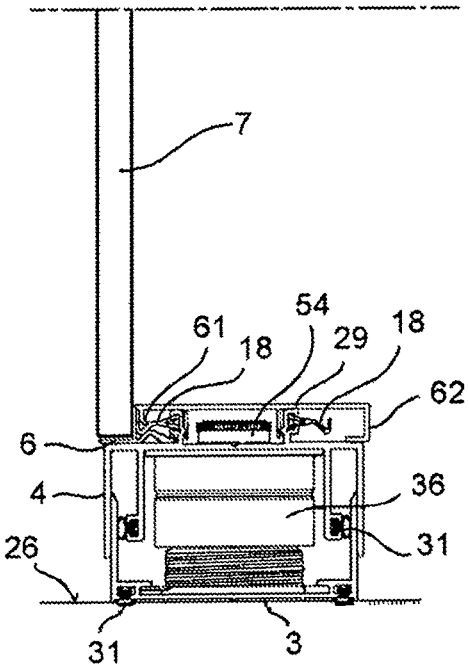
FIG. 24 shows in cross-sectional view the partition wall of FIG. 22 in which the covering and finishing section bar is arranged fitted onto the telescopic section bar to lock the snap-coupling device, by a special locking projection or snug, and to cover the non-used invitation and coupling seat.
Figure 25:
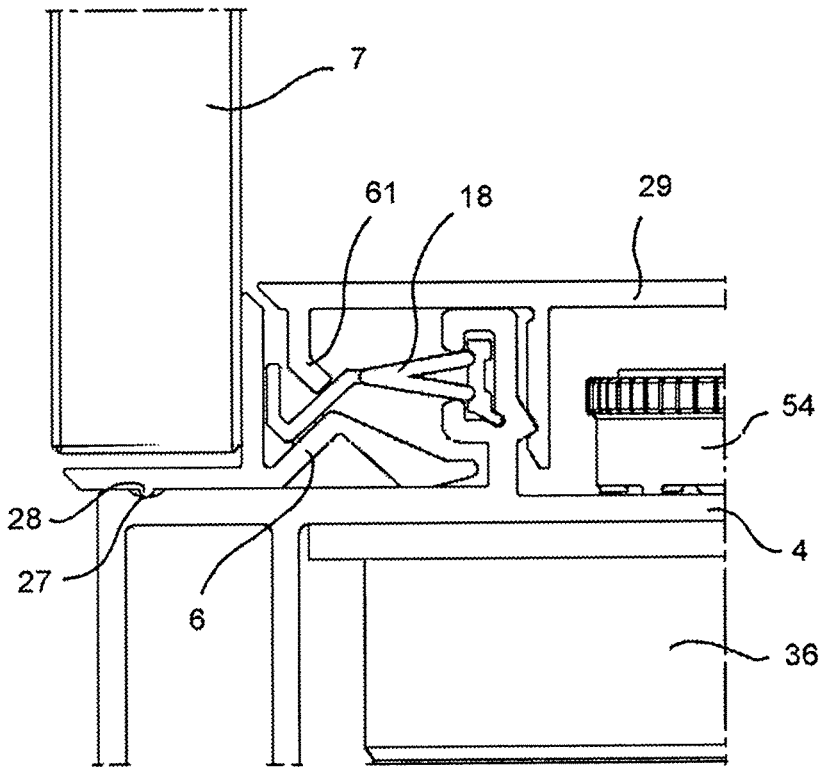
FIG. 25 shows an enlarged particular of FIG. 24.
Figure 26:
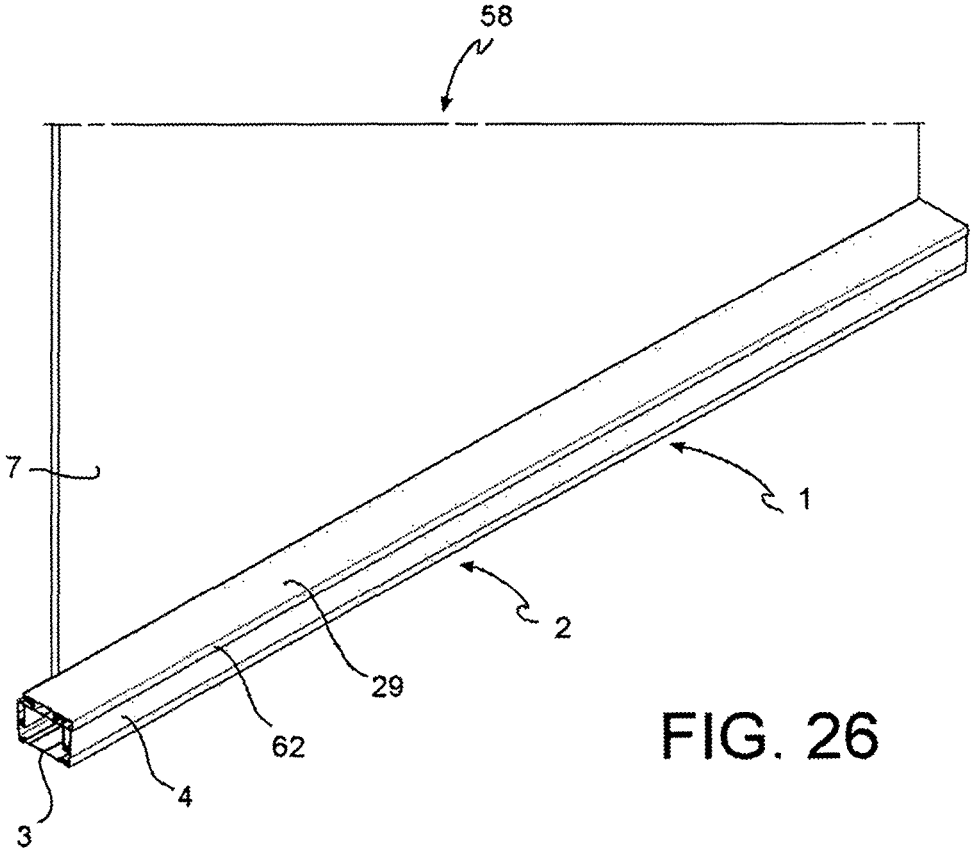
FIG. 26 illustrates in axonometric view the partition wall of FIG. 22, in which the covering and finishing section bar is arranged fitted onto the telescopic section bar to lock the snap-coupling device, by a special locking projection or snug, and to cover the non-used invitation and coupling seat.

With reference to the above-mentioned figures, and in accordance with a general embodiment, a modular frame structure 1 of a partition wall made of glass panes, or other pane material, or more simply pane 7, comprises a side assembly 2 to form at least one of the lower side, or base, of the frame structure 1, or the upper side, or cross bar, of the frame structure 1, or a mount, or column member arranged between the base and the cross bar, of the frame structure 1.

Said side assembly 2 comprises a track 3 suitable to firmly connect to the ceiling or the floor, or a support structure. Said track 3 has a body extending along a preset first longitudinal extent $\mathcal{H}\ \mathcal{H}$.

Said assembly further comprising a telescopic section bar 4, suitable to be connected to said track 3, for example, but not necessarily, fitted on said track so as to cover it substantially completely.

Said telescopic section bar 4 forms at least one invitation and coupling seat 5 facing the exterior of the section bar and is suitable to receive a coupling section bar 6 secured to said pane 7, for example, but not necessarily, a coupling section bar 6 firmly secured to an edge of the pane, the coupling of which to the frame structure is desired.

Said invitation and coupling seat 5 is defined by a sliding and resting wall 8 that with an edge 9 thereof defines a seat opening 10 through which the seat 5 opens to the outside of said telescopic section bar 4.

Said invitation and coupling seat 5 is also defined by a bottom wall 11 comprising a snap-coupling device seat 12, in which a snap-coupling device (18) is received by a base portion 17 thereof, so that a body portion 19 thereof projects cantilever in said invitation and coupling seat 5 and, facing said sliding and resting wall 8, forms therewith a coupling slit 20 that, in disengaging conditions, has reduced dimensions going towards said seat opening 10.

Said body portion 19 of said snap-coupling device 18 has a shape and is made of a material allowing an elastic deformation thereof to snap-receive said coupling section bar 6 in said coupling slit 20 so that an undercut 16 provided for in said coupling section bar 6 is coupled by the mutual action of the snap-coupling device 18 and the sliding and resting wall 8.

In accordance with an embodiment, at least one of
said track 3 or
said telescopic section bar 4 or
said coupling section bar 6 or
said snap-coupling device 18
is an extruded section bar.

In accordance with an embodiment, said snap-coupling device 18 is coextruded with said telescopic section bar 6, for example, but not necessarily, by securing by co-extrusion to the snap-coupling device seat 12. Preferably, said snap-coupling device 18 is made of a coloured material, for example, a red material, so that it can be well visible during the assembling steps, preventing it from being erroneously stepped on.

In accordance with an embodiment, said assembly comprises a coupling section bar 6 having a body 13 projecting cantilever from a base 14 along a second extension direction Y-Y and forms a free end 15 defining an undercut 16 with respect to the extension direction Y-Y, for example, a thickened or folded free end.

In accordance with an embodiment, said coupling section bar 6 is firmly connected to said pane 7, for example, at an edge to be connected to the frame structure of said pane.

In accordance with an embodiment, said pane 7 has its own outer surface 22, and said track 3 or said telescopic section bar 4 comprises a side surface 21 facing outwardly of the frame structure 1. Said invitation and resting seat 5 is arranged in the telescopic section bar 4 so that the pane 7, when it is snap connected through the coupling section bar 6 has its outer surface 22 substantially flush or co-planar with the side surface 21.

In accordance with an embodiment, said invitation and coupling seat 5, said snap-coupling device 18, and said coupling slit 20 extend along the entire longitudinal extent of the telescopic section bar 4.

In accordance with an embodiment, said side assembly 2 forma the upper side, or cross bar, of the frame structure 1, and said upper side has an upper resting surface 23 suitable to rest and/or connect to an upper resting plane 24, for example, a ceiling or a support structure, for example, a support structure of a false ceiling.

In accordance with an embodiment, said invitation and coupling seat 5 forms with said snap-coupling device 18 a coupling slit 20 extending, in a section transversal to the longitudinal extent of the telescopic section bar 4, substantially orthogonally to said upper resting surface 23.

In accordance with an embodiment, said invitation and coupling seat 5 forms with walls thereof, for example, with said sliding and resting wall 8, or an extension thereof, a support for the coupling section bar 6 secured to said pane 7 so as to prevent the accidental overturning of said pane 7.

In accordance with an embodiment, said side assembly 2 forma the lower side, or base, of the frame structure 1, and has a lower resting surface 25 suitable to rest and/or connect to a lower resting plane 26, for example, a floor or a support structure.

In accordance with an embodiment, said invitation and coupling seat 5 forms with said snap-coupling device 18 a coupling slit 20 that, in the section transversal to the longitudinal extent of said telescopic section bar 4, extends substantially parallel to said lower resting surface 25, so that said coupling section bar 6, secured to said pane 7, may slide against said sliding and coupling wall 8, and/or an extension thereof, entering said seat 5 and resting the weight of said pane 7 on said sliding and coupling wall 8 and/or an extension thereof.

In accordance with an embodiment, in said sliding and coupling wall 8, or an extension thereof, a channel 27 is provided for. In accordance with an embodiment, said channel 27 is for example provided for in said sliding and coupling wall 8 of a lower side assembly, or base.

In accordance with an embodiment, in said coupling section bar 6 is a rib 28 provided for. In accordance with an embodiment, said rib 28 is provided for in said coupling section bar 6 connected to the pane 7 in the proximity of a lower edge thereof, suitable to rest and couple said lower side assembly.

In accordance with an embodiment, in an engaging position in which said pane 7 is rested and coupled to said frame structure 1, said rib 28 engages with said channel 27 so that the weight of the pane 7 prevents the accidental moving away of the pane 7 from the lower side assembly 2 without a voluntary prearranged lifting of the pane 7.

In accordance with an embodiment, said side assembly 2 comprises a covering and finishing section bar 29 suitable to couple to said telescopic section bar 4 to cover the side assembly 2, hiding to the sight said section bars and showing a finishing surface 30 facing the direction opposite to said side assembly 2.

In accordance with an embodiment, said finishing surface 30 and said side surface 21 are substantially the only visible surfaces of said side assembly 2 when they are in the mounted and operative condition with pane 7, or panes, rested and coupled.

In accordance with an embodiment, said finishing surface 30 and/or said side surface 21 comprise aesthetical means, for example aesthetical treatments or veneers or similar decorations.

In accordance with an embodiment, between said track 3 and said telescopic section bar 4 at least one acoustic gasket 31 is provided for, which is arranged in a position cut off from sight of the assembled and operative side assembly 2.

In accordance with an embodiment, said acoustic gasket 31 extends along the entire longitudinal extent of said side assembly 2.

In accordance with an embodiment, said telescopic section bar 4 is so shaped as to fit, for example, telescopically and externally, on the track 3 and substantially cut it off from sight.

In accordance with an embodiment, a side assembly 2 comprises two opposite invitation and coupling seats 5 forming with respective snap-coupling devices 18, opposite coupling slits 20 for the snap-coupling of panes 7 facing to form a double pane partition wall.

In accordance with a general embodiment, a side assembly 2, suitable to form at least one of the lower side, or base, of the frame structure 1, or the upper side, or cross bar, of the frame structure 1, or a mount, or column member arranged between the base and the cross bar, of the frame structure 1, comprises a track 3 suitable to firmly connect to the ceiling or the floor or a support structure.

Said track 3 has a body extending along a preset first longitudinal extent X-X.

In accordance with an embodiment, said track 3 comprises a lower wall 32.

In accordance with an embodiment, said assembly further comprises a telescopic section bar 4, suitable to be connected to said track 3. Said telescopic section bar 4 comprises an upper wall 34.

In accordance with an embodiment, said telescopic section bar 4 is fitted on said track 3 and between said track 3 and said telescopic section bar 4 at least one frame structure adjusting jack 36 is interposed, which is suitable to locally modify the distance between said track 3 and said telescopic section bar 4, for example to level said telescopic section bar 4 with respect to an optionally irregular resting plane 26, for example, a floor, of the track 3.

In accordance with an embodiment, said upper wall 34 of said telescopic section bar 4 comprises a connection hole 37 defined by a hole edge 39.

In accordance with an embodiment, said frame structure adjusting jack comprises snap-connection extensions 38 suitable to insert in said connection hole 37 and snap-couple on said hole edge 39 of said upper wall 34 of said telescopic section bar 4, thus connecting said jack 36 to said telescopic section bar 4.

In accordance with an embodiment, said track 3 comprises a lower wall 32 having an inner lower resting surface 33 and track ribs 42 defining undercut track seats extending longitudinally in the proximity of said lower resting surface 33, for example, extending laterally to this surface 33 along the entire longitudinal length of the track 3.

In accordance with an embodiment, said telescopic section bar 4 comprises an upper wall 34 having an inner upper resting surface 35.

In accordance with an embodiment, said jack 36 comprises a lower jack resting base 40 that, under operative conditions, is rested on said inner lower resting surface 33.

In accordance with an embodiment, said lower jack resting base 40 has undercut coupling side extensions 41.

In accordance with an embodiment, said undercut coupling side extensions 41, under operative conditions, engage in said undercut track seats firmly connecting the lower jack resting base 40 to said lower wall 32 of track 3.

In accordance with an embodiment, said lower jack resting base 40 has a lower base wrench seat 43, for example, a polygonal-edged lower hole, suitable to engage a maneuvering wrench for the rotation of said lower jack resting base 40 from a disengaging position, in which said undercut coupling side extensions 41 are uncoupled or external to said undercut track seats, to an operative engaging position in which said undercut coupling side extensions 41 engage in said undercut track seats firmly connecting the lower jack resting base 40 to said lower wall 32 of track 3.

In accordance with an embodiment, from said lower jack resting base 40 a threaded stem 44 projects, extending towards said telescopic section bar 4 when the telescopic section bar is fitted on said track 3.

In accordance with an embodiment, said threaded stem 44 is in a single piece with said lower jack resting base 4.

In accordance with an embodiment, said threaded stem 44 is of a cylindrical shape and has a stem thread 45 external to its cylindrical body.

In accordance with an embodiment, at a preset height of said threaded stem 44 a preset break line 46 is provided for, suitable to divide an end portion of the threaded stem 44 for a reduction of the extension thereof in case of use in lowered side assemblies 2.

In accordance with an embodiment, said jack 36 comprises an upper resting base 47 that, under operative conditions, is rested on said inner upper resting surface 35.

In accordance with an embodiment, from said upper resting base 47 a sleeve or a threaded cylinder 48 projects, for example, but not necessarily, in a single piece, fitted threaded on said threaded stem 44, so as to adjust the distance between said upper resting base 47 and a lower resting base 40.

In accordance with an embodiment, said upper resting base 47 has an upper base wrench seat 49, for example, a polygonal-edged upper through hole.

In accordance with an embodiment, said polygonal-edged upper through hole 49 has dimensions larger than the polygonal-edged lower hole, so as to allow the passage through the polygonal-edged upper through hole 49 of a maneuvering wrench suitable to engage in said lower hole and to maneuver said lower resting base 40 without maneuvering the upper resting base 47, but operating only through said upper hole 49.

In accordance with an embodiment, from said upper resting base 47 at least one snap-coupling extension or petal 50 projects from the opposite side to the threaded sleeve 48.

In accordance with an embodiment, said at least one snap-coupling extension or petal 50 comprises a plurality of elastically deformable petals 50, for example arranged about said polygonal-edged upper through hole 49, to be able to be elastically deformed in a bunched up position to be inserted into said connection hole 37 of the upper wall of telescopic section bar 34 and come back to the extended position in an undercut snap-coupling on the opposite side of the upper wall 34 with respect to the upper resting base 47.

In accordance with an embodiment, said plurality of elastically deformable petals 50 has a petal neck 51 having dimensions reduced with respect to a petal head 52 arranged at the free end of the petal 50. In accordance with an embodiment, said petal neck 51 is suitable to receive an undercut with respect to the petal head 52, the edge of the connection hole 37 putting the petal head to couple with the upper wall of telescopic section bar 34 so as to prevent the petal 50 from exiting the connection hole 37.

In accordance with an embodiment, the at least one petal 50, in a snap-engaging position with the edge of the connection hole 37, defines a petal passage or hole 53, for example, arranged centrally to the plurality of petals 50, so as to leave a free passage for maneuvering wrenches suitable to engage with wrench seats 43, 49 provided for in said lower and upper resting bases 40, 47, operating only through said connection hole 37 of the telescopic section bar 4.

In accordance with an embodiment, a safety plug 54 is provided for, having a plug stem 55 suitable to insert in said petal hole 53 to lock said at least one petal 50 in an engaged position with said edge of connection hole 37, locking the connection between said upper jack resting base 47 and said telescopic section bar 4 and so as to prevent that the petals get a bunched up position and may be withdrawn from the connection hole 37.

In accordance with an embodiment, said plug stem 55 comprises elastically deformable plug petals to snap-couple to the upper jack resting base 47 passing through the polygonal upper hole 49.

In accordance with an embodiment, said safety plug 54 comprises a plug base 56 suitable to cover and protect the at least one petal 50, for example the petal head 52 to cut the petals off from sight.

In accordance with an embodiment, the upper resting base 47 and/or lower resting base 40 of the jack have an extension transversal to the threaded sleeve 48 and the threaded stem 44, respectively, such as to rest on at least ⅔ of the inner upper resting surface 23 and the inner lower resting surface 33, respectively.

In accordance with an embodiment, the upper resting base 47 and/or lower resting base 40 of the jack have an extension transversal to the threaded sleeve 48 and the threaded stem 44, respectively, substantially equal to the entire free extension of the inner upper resting surface 23 and inner lower resting surface 33.

In accordance with an embodiment, said internally threaded sleeve 48 has a preset-breakage circumferential line 57 suitable to shorten the longitudinal extent of the sleeve 48 in the case of an application in a side assembly 2 that is lowered or with reduced dimensions, without providing a separate and different jack 36.

In accordance with a general embodiment, a modular partition wall 58 comprises a frame structure as described above in any of the embodiments, and comprises at least one pane 7 snap connected with its coupling section bars 6 in respective coupling slits 20 provided for in respective side assemblies 2 of the frame structure 1.

In accordance with an embodiment, said pane 7 is a pane made of glass or a similar material, or a pane made of plasterboard or a similar material, or a plurality of panes vertically placed side by side, or a plurality of panes horizontally placed side by side.

In accordance with an embodiment, said modular partition wall comprises an upper side assembly 2, or cross bar, and a lower side assembly 2, or base, and comprises at least one pane 7 having an upper pane edge 59 to which a coupling pane section bar 6 is connected, and a lower pane edge 60 to which a coupling pane section bar 6 is connected.

Said pane 7 is snap coupled superiorly and inferiorly in respective coupling slits 20 provided for in the respective upper and lower side assemblies 2.

In accordance with an embodiment, said wall comprises a coupling section bar 6 having a body 13 projecting cantilever from a base 14 along a second extension direction Y-Y and forms a free end 15 defining an undercut 16 with respect to the extension direction Y-Y, for example a thickened or folded free end.

In accordance with an embodiment, said coupling section bar 6 is firmly connected to said pane 7, for example, at an edge to be connected to the frame structure of said pane.

A method for mounting the frame structure and the partition wall will be described herein below.

A method for mounting a pane 7 to a modular frame structure 1 of a partition wall made of glass panes, or other pane material, comprises the following steps:

- providing a frame structure 1 as in any of the embodiments, described above;
- providing a pane 7 having a pane edge 59; 60 to which a coupling pane section bar 6 is connected;
- snap coupling the coupling pane section bar 6 in the coupling slit 20 of the side assemblies 2 of said frame structure 1.

In accordance with a further method the following steps are encompassed, of:

- providing a frame structure 1 and a frame structure adjusting jack 36 as in any of the embodiments, described above;
- snap coupling said jack 36 to the connection 37 of the telescopic section bar 4.

In accordance with a possible operation mode, a method comprises the following further steps:

- fitting the telescopic section bar 4 on the track 3;
- adjusting the position of the telescopic section bar 4 with respect to the track 3, by operating on the jack 36 through the connection hole 37.

In accordance with a possible operation mode, a mounting method comprises at least one of the, but also all, the following steps:

- securing the track 3 al lower resting plane 26, or floor; and/or
- snap connecting the jack 36 al connection hole 37 of the telescopic section bar 4; and/or
- fitting the telescopic section bar 4 on the track 3; and/or
- undercut coupling with respect to the track ribs 42 the lower resting base 40 of the jack 36, for example, by a rotation of the base 40 with a maneuvering wrench inserted into the lower polygonal hole; and/or
- adjusting the jack 36 height by the rotation, for example, with the maneuvering wrench engaging the upper polygonal hole 49 by rotating the internally threaded sleeve 48; and/or
- adjusting the optional plurality of jacks 36 arranged between the track 3 and the telescopic section bar 4 levelling the side assembly 2; and/or
- locking the snap-coupling petals 50 of the jack 36 inserting the safety plug 54; and/or
- connecting the upper side assembly track 3, or cross bar; and/or
- fitting the telescopic section bar 4 on said track 3 of the upper side assembly; and/or
- inserting and snap connecting the upper coupling section bar 6 connected to an upper edge 59 of a first pane 7 in the upper slit 20 of the upper side assembly 2;
- rotating the pane 7 inferiorly, inserting and snap connecting the lower coupling section bar 6, connected to a lower edge 60 of the first pane 7, in the lower slit 20 of the lower side assembly 2; and/or
- resting the lower coupling section bar 6 above the sliding and resting wall 8, inserting the rib 28 in the channel 27; and/or
- fitting the upper and lower covering and finishing section bars 29 to cover the telescopic section bars 4, cutting the connections of the assembly 2 from sight; and/or
- repeating the operation for a second pane 7 placed side by side to the first pane 7 or facing the first pane 7 by using opposite coupling slits 20 provided for in the same side assemblies 2.

It shall be apparent that those skilled in the art, in order to meet contingent, specific needs, will be able to make a number of modifications and variations to the assembly according to the invention, all anyhow contained in the protection scope of the invention, as defined by the following claims.

In accordance with an embodiment, to cover of the telescopic section bar 4, and particularly the visible portion of invitation and coupling seat 5, after the snap coupling of the pane 7, a covering and finishing section bar 29 is provided for comprising an extension, or locking snug of the covering and finishing section bar 61 which, under the coupled condition with the telescopic section bar 4, projects in the proximity of the snap-coupling device 18, preventing the elastic deformation thereof to make of the coupling section bar 6 exit from the coupling slit 20, so as to prevent the accidental uncoupling of the pane 7 once covering and finishing section bar 29 is in the seat.

By virtue of this snug 61, even in the case that the partition wall has a pane only on one side of the side assembly 2 and thus engages an invitation and coupling seat 5 arranged on a side and is accidentally hittable from the side opposite the snap coupling direction with an action aimed to uncoupled the wall, the snug, preventing the elastic deformation of the snap-coupling device 18, prevents the uncoupling of the coupling section bar 6 and thus of the pane 7.

In accordance with an embodiment, said extension, or locking snug of the covering and finishing section bar 61, extends along the entire longitudinal extent of the covering and finishing section bar 29.

In accordance with an embodiment, to cover the telescopic section bar 4, a covering and finishing section bar 29 is provided for, comprising a covering side wall of the covering and finishing section bar 62 that, when the covering and finishing section bar 29 is coupled to the telescopic section bar 4, covers, cutting off from sight, an invitation and coupling seat 5 optionally not used in the case of a partition wall with a pane on only one side, or a partition wall with a single pane.

In accordance with an embodiment, said covering side wall of the covering and finishing section bar 62 extends along the entire longitudinal extent of the covering and finishing section bar 29.

In accordance with a possible embodiment, a modular frame structure 1 of a partition wall made of glass panes, or other pane material, or pane 7, comprises

- a side assembly 2 to form at least one of the lower side, or base, of the frame structure 1, or the upper side, or cross bar, of the frame structure 1, or a mount, or column member arranged between the base and the cross bar, of the frame structure 1;
- said side assembly 2 comprising
- a track 3 suitable to firmly connect to the ceiling or the floor or a support structure, said track 3 having a body extending along a preset first longitudinal extent X-X;
- said track 3 comprising a lower wall 32;
- said assembly further comprising a telescopic section bar 4, available to be connected to said track 3;
- said telescopic section bar 4 comprising an upper wall 34;
- said telescopic section bar 4 being fitted on said track 3;
- between said track 3 and said telescopic section bar 4, at least one frame structure adjusting jack 36 is interposed, which is suitable to locally modify the distance between said track 3 and said telescopic section bar 4, for example, to level said telescopic section bar 4 with respect to an optionally irregular resting plane 26, for example, a floor, of the track 3;

wherein said upper wall 34 of said telescopic section bar 4 comprises a connection hole 37 defined by a hole edge 39, and wherein said frame structure adjusting jack comprises snap-connection extensions 38 suitable to insert in said connection hole 37 and snap-couple on said hole edge 39 of said upper wall 34 of said telescopic section bar 4, thus connecting said jack 36 to said telescopic section bar 4.

In accordance with an embodiment, a modular frame structure 1 comprises one or more of the characteristics described above, and it further comprises the following characteristics:

said track 3 comprises a lower wall 32 having an inner lower resting surface 33 and track ribs 42 defining undercut track seats 43 extending longitudinally in the proximity of said lower resting surface 33, for example, extending laterally to this surface 33 along the entire longitudinal length of the track 3; and wherein said telescopic section bar 4 comprises an upper wall 34 having an inner upper resting surface 35; and wherein said jack 36 comprises a lower jack resting base 40 that, under operative conditions, is rested on said inner lower resting surface 33; and wherein said lower jack resting base 40 has undercut coupling side extensions 41; and wherein said undercut coupling side extensions 41, under operative conditions, engage in said undercut track seats 43 firmly connecting the lower jack resting base 40 to said lower wall 32 of track 3; and/or wherein said lower jack resting base 40 has a lower base wrench seat 43, for example, a polygonal-edged lower hole, suitable to engage a maneuvering wrench for the rotation of said lower jack resting base 40 from a disengaging position, in which said undercut coupling side extensions 41 are uncoupled or external to said undercut track seats 43, to an operative engaging position in which said undercut coupling side extensions 41 engage in said undercut track seats 43 firmly connecting the lower jack resting base 40 to said lower wall 32 of track (3); and/or wherein from said lower jack resting base 40 a threaded stem 44 projects, extending towards said telescopic section bar 4 when the telescopic section bat is fitted on said track 3; and/or wherein said threaded stem 44 is in a single piece with said lower jack resting base 40; and/or wherein said threaded stem 44 is of a cylindrical shape and has a stem thread 45 external to its cylindrical body; and/or wherein at a preset height of said threaded stem 44, a preset break line 46 is provided for, suitable to divide an end portion of the threaded stem 44 for a reduction of the extension thereof in case that lowered side assemblies 2 are used; and/or wherein said jack 36 comprises an upper resting base 47 that, under operative conditions, is rested on said inner upper resting surface 35; and wherein from said upper resting base 47 a sleeve or a threaded cylinder 48 projects, fitted threaded on said threaded stem 44 so as to adjust the distance between said upper resting base 47 and a lower resting base 40; and/or wherein said upper resting base 47 has an upper base wrench seat 49, for example, a polygonal-edged upper through hole; and/or wherein said polygonal-edged upper through hole 49 has dimensions larger than the polygonal-edged lower hole 43, so as to allow the passage through the polygonal-edged upper through hole 49 of a maneuvering wrench suitable to engage in said lower hole 43 and to maneuver said lower resting base 40 without maneuvering the upper resting base 47 but operating only through said upper hole 49; and/or wherein from said upper resting base 47 project, from the opposite side to the threaded sleeve 48, at least one snap-coupling extension or petal 50; and/or wherein said at least one snap-coupling extension or petal 50 comprises a plurality of elastically deformable petals 50, for example, arranged about said polygonal-edged upper through hole 49, to be able to be elastically deformed in a bunched up position to be inserted into said connection hole 37 of the upper wall of telescopic section bar 34 and come back to the extended position in an undercut snap-coupling on the opposite side of the upper wall (34) with respect to the upper resting base 47; and/or wherein said plurality of elastically deformable petals 50 has a petal neck 51 having dimensions reduced with respect to a petal head 52 arranged at the free end of the petal 50, said petal neck 51 being suitable to receive an undercut with respect to the petal head 52 the edge of the connection hole 37 putting the petal head to couple with the upper wall of telescopic section bar 34 so as to prevent the petal 50 from exiting the connection hole 37; and/or wherein the at least one petal 50 in a snap-engaging position with the edge of the connection hole 37 defines a petal passage or hole 53, for example, arranged centrally to the plurality of petals 50, so as to leave a free passage for maneuvering wrenches suitable to engage with wrench seats 43, 49 provided for in said lower and upper resting bases 40, 47, operating only through said connection hole 37 of the telescopic section bar 4; and/or wherein a safety plug 54 is provided for, having a plug stem (55) suitable to insert in said petal hole 53 to lock said at least one petal 50 in an engaged position with said edge of connection hole 37, locking the connection between said upper jack resting base 47 and said telescopic section bar 4 and so as to prevent that the petals get a bunched up position and may be withdrawn from the connection hole 37; and/or wherein said plug stem 55 comprises elastically deformable plug petals to snap-couple to the upper jack resting base 47 passing through the polygonal upper hole 49; and/or wherein said safety plug 54 comprises a plug base (56) suitable to cover and protect the at least one petal 50, for example the petal head 52 to cut the petals off from sight; and/or wherein the upper resting base 47 and/or the lower resting base 40 of the jack have an extension transversal to the threaded sleeve 48 and the threaded stem 44, respectively, such as to rest on at least ⅔ of the inner upper resting surface 23 and the inner lower resting surface 33; and/or wherein the upper resting base 47 and/or the lower resting base (40) of the jack have an extension transversal to the threaded sleeve 48 and the threaded stem 44, respectively, substantially equal to the free extension of the inner upper resting surface 23 and the inner lower resting surface 33; and/or wherein said internally threaded sleeve 48 has a preset-breakage circumferential line 57 suitable to shorten the longitudinal extent of the sleeve 48 in the case of an application in side assembly 2 that is lowered or with reduced dimensions, without providing a separate and different jack 36.

REFERENCES

1 Frame structure
2 side assembly
3 track
4 telescopic section bar
5 invitation and coupling seat
6 coupling section bar
7 pane
8 sliding and resting wall
9 Wall edge
10 seat opening
11 bottom wall
12 snap-coupling device seat
13 coupling section bar body
14 coupling section bar base
15 coupling section bar free end
16 coupling section bar undercut
17 base portion of the snap-coupling device
18 snap-coupling device
19 body portion of the snap-coupling device
20 coupling slit
21 side surface
22 outer pane superficie
23 upper resting surface
24 upper resting plane
25 lower resting surface
26 lower resting plane
27 channel
28 rib
29 covering and finishing section bar
30 finishing surface
31 acoustic gasket
32 lower wall of track
33 inner lower resting surface
34 upper wall of telescopic cootion bar
35 inner upper resting surface
36 frame structure adjusting jack
37 connection hole
38 snap-connection extensions
39 hole edge
40 lower jack resting base
41 undercut coupling side extensions
42 track ribs
43 lower base wrench seat
44 threaded stem
45 stem thread
46 preset break line
47 upper resting base
48 threaded sleeve
49 upper base wrench seat
50 snap-coupling extensions or petals
51 petal neck
52 petal head
53 petal hole
54 safety plug
55 plug stem
56 plug base
57 preset-breakage circumferential line of sleeve
58 partition wall
59 upper pane edge
60 lower pane edge
X-X side assembly longitudinal direction
Y-Y snap coupling section bar extension direction
61 locking snug of the covering and finishing section bar
62 covering side wall of the covering and finishing section bar

The invention claimed is:

1. A modular frame structure of a partition wall, the partition wall comprising a pane, the modular frame structure comprising:

a side assembly configured to form at least one of: a lower side assembly of the modular frame structure or an upper side assembly of the modular frame structure, said side assembly comprising:

a track suitable to firmly connect to a ceiling or a floor or a support structure, said track having a track body extending along a preset first longitudinal extent;

a telescopic section bar configured to be connected to said track;

said telescopic section bar comprising at least one invitation and coupling seat, the at least one invitation and coupling seat configured to receive a coupling section bar secured to said pane;

said invitation and coupling seat being defined by a sliding and resting wall that with an edge thereof defines a seat opening through which the seat opens to the outside of said telescopic section bar;

said invitation and coupling seat being further defined by a bottom wall comprising a snap-coupling device seat, the snap-coupling device seat configured to receive a snap-coupling device is received with a base portion thereof so that a body portion thereof projects cantilever in said invitation and coupling seat and, facing said sliding and resting wall, forms therewith a coupling slit that, in disengaging conditions, has reduced dimensions going towards said seat opening; and said body portion of said snap-coupling device having a shape and a material allowing an elastic deformation thereof to snap-receive said coupling section bar in said coupling slit so that an undercut provided for in said coupling section bar is coupled by mutual action of the snap-coupling device and the sliding and resting wall.

2. The modular frame structure according to claim 1, wherein at least one of said track, said telescopic section bar, said coupling section bar, and said snap-coupling device is an extruded section bar, or wherein said snap-coupling device is coextruded with said telescopic section bar.

3. The modular frame structure, according to claim 1, wherein said pane has a pane outer surface, and wherein said track or said telescopic section bar comprises a side surface facing outwardly of the modular frame structure, and wherein said invitation and resting seat is arranged so that when the coupling section bar secured to the pane is snap connected, the pane outer surface is substantially flush with the side surface.

4. The modular frame structure, according to claim 1, wherein said invitation and coupling seat, said snap-coupling device, and said coupling slit extend along an entire longitudinal extent of the telescopic section bar; wherein a first side assembly forms an upper side assembly of the modular frame structure, said upper side assembly has an upper resting surface suitable to rest or connect to an upper resting plane; and wherein a first invitation and coupling seat forms with a first snap-coupling device a first coupling slit extending, in a section transversal to the longitudinal extent of a first telescopic section bar, substantially orthogonally to said upper resting surface, and wherein said first invitation and coupling seat forms with walls thereof a support for a first coupling section bar secured to said pane and configured to prevent accidental overturning of said pane; wherein a second side assembly forms the lower side assembly of the modular frame structure, said lower side assembly has a lower resting surface suitable to rest or connect to a lower resting plane, and wherein a second invitation and coupling seat forms with a second snap-coupling device a second coupling slit that, in the section transversal to the longitudinal extent of said telescopic section bar, extends substantially parallel to said lower resting surface, so that a second coupling section bar secured to said pane is configured to slide against a second sliding and coupling wall or a second extension, entering said second invitation and coupling seat and resting a weight of said pane on said second sliding and coupling wall or the second extension; wherein a channel is provided for in said second sliding and coupling wall of said lower side assembly; and wherein a rib is provided for in said second coupling section bar connected to the pane in proximity of a lower edge of the pane, said pane suitable to rest and couple said lower side assembly;

and wherein in an engaging position in which said pane is rested and coupled to said modular frame structure, said rib engages with said channel so that the weight of the pane prevents accidental movement of the pane away from the lower side assembly without a voluntary prearranged lifting of the pane.

5. The modular frame structure according to claim 1, wherein said track comprises a lower wall;

wherein said telescopic section bar comprises an upper wall;

said telescopic section bar being fitted on said track;

at least one frame structure adjusting jack is interposed between said track and said telescopic section bar, the at least one frame structure adjusting jack suitable to locally modify a distance between said track and said telescopic section bar, the at least one frame structure adjusting jack optionally configured to level said telescopic section bar with respect to an irregular resting plane of the track; wherein said upper wall of said telescopic section bar comprises a connection hole defined by a hole edge; and wherein said frame structure adjusting jack comprises snap-connection extensions suitable to insert in said connection hole and snap-couple on said hole edge of said upper wall of said telescopic section bar, thus connecting said jack to said telescopic section bar.

6. The modular frame structure according to claim 5, wherein said lower wall of said track has an inner lower resting surface and track ribs defining undercut track seats extending longitudinally in proximity of said lower resting surface, optionally extending laterally to the inner lower resting surface along an entire longitudinal length of the track; and wherein said telescopic section bar comprises an upper wall having an inner upper resting surface; and wherein said jack comprises a lower jack resting base that, under operative conditions, is rested on said inner lower resting surface; and wherein said lower jack resting base has undercut coupling side extensions; and wherein said undercut coupling side extensions, under operative conditions, engage in said undercut track seats firmly connecting the lower jack resting base to said lower wall of said track; wherein said lower jack resting base has a lower base wrench seat suitable to engage a maneuvering wrench to rotate said lower jack resting base from a disengaging position, in which said undercut coupling side extensions are uncoupled or external to said undercut track seats, to an operative engaging position in which said undercut coupling side extensions engage in said undercut track seats firmly connecting the lower jack resting base to said lower wall of said track; wherein from said lower jack resting base a threaded stem projects, extending towards said telescopic section bar when the telescopic section bar is fitted on said track; wherein said threaded stem is in a single piece with said lower jack resting base; wherein said threaded stem is of a cylindrical shape, and has a stem thread external to its cylindrical body; wherein at a preset height of said threaded stem, a preset break line is provided for, suitable to divide an end portion of the threaded stem for a reduction of the extension thereof when lowered side assemblies are used; wherein said jack comprises an upper resting base that, under operative conditions, is rested on said inner upper resting surface; and wherein from said upper resting base a threaded sleeve projects, fitted threaded on said threaded stem and configured to adjust the distance between said upper resting base and a lower resting base; wherein said upper resting base has an upper base wrench seat; wherein said upper base wrench seat has dimensions larger than the lower base wrench seat, the upper base wrench seat configured to allow passage through of a maneuvering wrench suitable to engage in said lower base wrench seat and to maneuver said lower resting base without maneuvering the upper resting base, but operating only through said upper base wrench seat; wherein from said upper resting base, at least one snap-coupling extension or petal projects from the opposite side to the threaded sleeve; wherein said at least one snap-coupling extension or petal comprises a plurality of elastically deformable petals, configured to be elastically deformed in a bunched up position for insertion into said connection hole of the upper wall of said telescopic section bar and return to an extended position in an undercut snap-coupling on the opposite side of the upper wall with respect to the upper resting base; wherein said plurality of elastically deformable petals has a petal neck having dimensions reduced with respect to a petal head arranged at a free end of the petal, said petal neck being suitable to receive an undercut with respect to the petal head, the edge of the connection hole putting the petal head to couple with the upper wall of the telescopic section bar so as to prevent the petal from exiting the connection hole; wherein the at least one snap-coupling extension or petal in a snap-engaging position with the edge of the connection hole defines a petal hole, so as to leave a free passage for maneuvering wrenches suitable to engage with wrench seats provided for in said lower and upper resting bases, operating only through said connection hole of the telescopic section bar; wherein a safety plug is provided for, having a plug stem suitable to insert in said petal hole to lock said at least one snap-coupling extension or petal in an engaged position with said edge of said connection hole, locking the connection between said upper resting base and said telescopic section bar and so as to prevent that the petals get a bunched up position and may be withdrawn from the connection hole; wherein said plug stem comprises elastically deformable plug petals to snap-couple to the upper resting base passing through the upper base wrench seat; wherein said safety plug comprises a plug base suitable to cover and protect the at least one snap-coupling extension or petal; wherein at least one of the upper resting base and the lower resting base of the jack have an extension transversal to the threaded sleeve and the threaded stem, respectively, configured to rest on at least ⅔ of the inner upper resting surface and the inner lower resting surface;

wherein at least one of the upper resting base and the lower resting base of the jack have an extension transversal to the threaded sleeve and the threaded stem, respectively substantially equal to a free extension of the inner upper resting surface and the inner lower resting surface; and optionally wherein said internally threaded sleeve has a preset-breakage circumferential line suitable to shorten the longitudinal extent of the threaded sleeve thereby lowering and reducing dimensions of the side assembly, without providing a separate and different jack.

7. A modular partition wall comprising a frame structure and at least one pane snap connected with via a coupling section bar in a coupling slit provided for in a side assembly of said frame structure wherein the frame structure comprises:

said side assembly configured to form at least one of: a lower side assembly of the frame structure or an upper side assembly of the frame structure, said side assembly comprising:

a track suitable to firmly connect to a ceiling or a floor or a support structure, said track having a track body extending along a preset first longitudinal extent;

a telescopic section bar configured to be connected to said track, said telescopic section bar comprising at least one invitation and coupling seat, the at least one invitation and coupling seat configured to receive the coupling section bar secured to said at least one pane;

said invitation and coupling seat being defined by a sliding and resting wall that with an edge thereof defines a seat opening through which the seat opens to the outside of said telescopic section bar;

said invitation and coupling seat being further defined by a bottom wall comprising a snap-coupling device seat, the snap-coupling device seat configured to receive a snap-coupling device is received with a base portion thereof so that a body portion thereof projects cantilever in said invitation and coupling seat and, facing said sliding and resting wall, forms therewith the coupling slit that, in disengaging conditions, has reduced dimensions going towards said seat opening; and said body portion of said snap-coupling device having a shape and a material allowing an elastic deformation thereof to snap-receive said coupling section bar in said coupling slit so that an undercut provided for in said coupling section bar is coupled by mutual action of the snap-coupling device and the sliding and resting wall.

8. The modular partition wall according to claim 7, wherein said pane is a glass pane or a plasterboard pane or a plurality of panes vertically placed side by side; wherein said modular partition wall comprises an upper side assembly, a lower side assembly, and at least one pane, the at least one pane having an upper pane edge to which a first coupling pane section bar is connected, and a lower pane edge to which a second coupling pane section bar is connected, wherein said pane is snap coupled superiorly and inferiorly in respective coupling slits provided for in the respective upper and lower side assemblies; wherein said wall comprises a first or second coupling pane section bar having a body projecting cantilever from a base along a second extension direction and forms a free end defining an undercut with respect to the extension direction; and wherein said first or second coupling pane section bar is firmly connected to said pane.

9. A mounting method for mounting a pane to a modular frame structure of a partition wall, comprising:

providing the modular frame structure comprising:

a side assembly configured to form at least one of: a lower side assembly of the modular frame structure or an upper side assembly of the modular frame structure, said side assembly comprising:

a track suitable to firmly connect to a ceiling or a floor or a support structure, said track having a track body extending along a preset first longitudinal extent;

a telescopic section bar configured to be connected to said track, said telescopic section bar comprising at least one invitation and coupling seat, the at least one invitation and coupling seat configured to receive a coupling section bar secured to said pane;

said invitation and coupling seat being defined by a sliding and resting wall that with an edge thereof defines a seat opening through which the seat opens to the outside of said telescopic section bar;

said invitation and coupling seat being further defined by a bottom wall comprising a snap-coupling device seat, the snap-coupling device seat configured to receive a snap-coupling device is received with a base portion thereof so that a body portion thereof projects cantilever in said invitation and coupling seat and, facing said sliding and resting wall, forms therewith a coupling slit that, in disengaging conditions, has reduced dimensions going towards said seat opening; and said body portion of said snap-coupling device having a shape and a material allowing an elastic deformation thereof to snap-receive said coupling section bar in said coupling slit so that an undercut provided for in said coupling section bar is coupled by mutual action of the snap-coupling device and the sliding and resting wall;

providing a pane having a pane edge to which a coupling pane section bar is connected; and snap coupling the coupling pane section bar in the coupling slit of the side assembly of said modular frame structure.

10. The mounting method according to claim 9, further comprising:

providing said modular frame structures;

providing a frame structure adjusting jack, the frame structure adjusting lack configured to be interposed between said track and said telescopic section bar, the frame structure adjusting lack being suitable to locally modify a distance between said track and said telescopic section bar;

wherein an upper wall of said telescopic section bar comprises a connection hole defined by a hole edge; and wherein said frame structure adjusting jack comprises snap-connection extensions suitable to insert in said connection hole and snap-couple on said hole edge of said upper wall of said telescopic section bar, thus connecting said frame structure adjusting lack to said telescopic section bar, snap coupling said frame structure adjusting jack to the connection hole of the telescopic section bar;

fitting the telescopic section bar on the track, wherein the telescopic section bar comprises an upper wall; and adjusting the distance of the telescopic section bar with respect to the track by operating on the frame structure adjusting jack through the connection hole.

11. The mounting method according to claim 9, further comprising at least one of:

securing the track to a lower resting plane;

snap connecting a frame structure adjusting jack to a connection hole of the telescopic section bar;

fitting the telescopic section bar on the track;

undercut coupling with respect to track ribs a lower jack resting base;

adjusting the frame structure adjusting jack height by rotation;

adjusting an optional plurality of jacks arranged between the track and the telescopic section bar levelling the side assembly;

locking snap-coupling petals of the frame structure adjusting jack inserting a safety plug;

connecting the track of the upper side assembly;

fitting the telescopic section bar on said track of the upper side assembly;

inserting and snap connecting an upper coupling section bar connected to an upper edge of a first pane in an upper slit of the upper side assembly;

rotating the first pane inferiorly, inserting and snap connecting the lower coupling section bar connected to a lower edge of the first pane in the lower slit of the lower side assembly;

resting the lower coupling section bar above the sliding and resting wall, inserting the rib into a channel;

fitting the upper and lower covering and finishing section bars to cover the telescopic section bars, cutting the connections of the assembly off from sight; and repeating the mounting method for a second pane placed side by side to the first pane or facing the first pane by using opposite coupling slits provided for in the same side assemblies.

12. The modular frame structure according to claim 1, wherein said side assembly comprises a coupling section bar having a body projecting cantilever from a base along a second extension direction and forms a free end defining an undercut with respect to the extension direction; and wherein said coupling section bar is firmly connected to said pane at an edge of the pane configured to be connected to the frame structure.

13. The modular frame structure according to claim 6, wherein said lower base wrench seat is a polygonal-edged lower hole;

wherein said upper base wrench seat is a polygonal-edged upper through hole, said polygonal-edged upper through hole having dimensions larger than the polygonal-edged lower hole, said polygonal-edged upper through hole configured to allow passage through the polygonal-edged upper through hole of a maneuvering wrench suitable to engage in said polygonal-edged lower hole and configured to operate only through said upper hole to maneuver said lower resting base without maneuvering the upper resting base; and optionally wherein said plurality of elastically deformable petals are arranged about said polygonal-edged upper through hole.

14. The mounting method according to claim 11, wherein undercut coupling with respect to the track ribs comprises rotating the lower resting base with a maneuvering wrench inserted into the lower polygonal hole; and wherein adjusting the jack height by the rotation comprises rotating the threaded sleeve with the maneuvering wrench engaging a polygonal-edged upper through hole.

15. The modular frame structure, according to claim 4, wherein each said side assembly further comprises a covering and finishing section bar configured to couple to said telescopic section bar to cover the side assembly and hide from sight said section bars and show a finishing surface facing a direction opposite to said side assembly; wherein said finishing surface and a side surface are substantially the only visible surfaces of said side assembly when the finishing surface and the side surface are in a mounted and operative condition with the pane rested and coupled; wherein said finishing surface or said side surface comprise aesthetical means; wherein at least one acoustic gasket is provided for between said track and said telescopic section bar, the at least one acoustic gasket is arranged in a position hidden from sight of the assembled and operative side assembly; wherein the at least one acoustic gasket extends along the entire longitudinal extent of said side assembly; wherein the telescopic section bar so shaped as to fit telescopically and externally, on the track and cut it off from sight; wherein each side assembly comprises two opposite invitation and coupling seats forming with respective snap-coupling devices opposite coupling slits for snap-coupling of panes facing to form a double pane partition wall; wherein to cover the telescopic section bar, and particularly a visible portion of invitation and coupling seat, after snap-coupling of the pane, the covering and finishing section bar is provided for, comprising an extension, or locking snug of the covering and finishing section bar that, in the coupled condition with the telescopic section bar, projects in the proximity of the snap-coupling device, thus preventing the elastic deformation thereof to make the coupling section bar exit from the coupling slit, so as to prevent the accidental uncoupling of the pane once the covering and finishing section bar is in the seat; wherein said extension, or locking snug of the covering and finishing section bar, extends along the entire longitudinal extent of the covering and finishing section bar; wherein the covering and finishing section bar is configured to cover the telescopic section bar when the covering and finishing section bar is coupled to the telescopic section bar, the covering and finishing section bar comprising a covering side wall covers, hiding from sight an invitation and coupling seat optionally not used when the partition wall only a single pane on one side; and wherein said covering side wall of the covering and finishing section bar extends along the entire longitudinal extent of the covering and finishing section bar.

* * * * *